US005922520A

United States Patent [19]

Nakamura et al.

[11] Patent Number: 5,922,520

[45] Date of Patent: Jul. 13, 1999

[54] PHOTOGRAPHIC PROCESSING METHOD AND TANK

[75] Inventors: Takashi Nakamura, Minami-ashigara; Yasuhisa Ogawa, Hadano, both of Japan

[73] Assignee: Fuji Photo Film Co., Ltd., Kanagawa, Japan

[21] Appl. No.: 08/109,732

[22] Filed: Aug. 20, 1993

Related U.S. Application Data

[63] Continuation of application No. 07/730,719, Jul. 16, 1991.

[30] Foreign Application Priority Data

Nov. 30, 1990 [JP] Japan ..... 2-334916
Jan. 24, 1991 [JP] Japan ..... 3-024137

[51] Int. Cl.[6] ..... G03C 5/395; G03C 7/44

[52] U.S. Cl. ..... 430/398; 430/399; 430/400

[58] Field of Search ..... 430/398, 399, 430/400; 204/109, 130, 144, 151, 180.1; 354/303, 305, 317, 324

[56] References Cited

U.S. PATENT DOCUMENTS 4,089,760 5/1978 Ono ..... 204/151
4,127,465 11/1978 Higgins ..... 204/109
4,128,464 12/1978 Idota ..... 204/151
4,217,188 8/1980 Ono ..... 204/109
4,311,574 1/1982 Ishikawa ..... 204/109

*Primary Examiner*—Hoa Van Le
*Attorney, Agent, or Firm*—Sughrue, Mion, Zinn, Macpeak & Seas, PLLC

[57] ABSTRACT

Silver halide photosensitive material after exposure is processed by developing it with a developer solution and then processing it with a processing solution having bleaching function and/or a processing solution having fixing function, while placing the developer solution and/or said processing solution having fixing function in contact with the other processing solution and/or an electrolyte solution through an anion exchange membrane, placing a cathode in the developer solution and/or the processing solution having fixing function and an anode in the other processing solution and/or the electrolyte solution, and conducting electricity therebetween. An alternative method involves placing the processing solution having bleaching function in contact with the other processing solution and/or an electrolyte solution through an anion exchange membrane, placing an anode in the processing solution having bleaching function and a cathode in the other processing solution and/or the electrolyte solution, and conducting electricity therebetween. The respective processing solutions maintain constant processing ability.

24 Claims, 12 Drawing Sheets

PHOTOGRAPHIC PROCESSING METHOD AND TANK

This is a continuation of application Ser. No. 07/730,719 filed Jul. 16, 1991.

BACKGROUND OF THE INVENTION

1. Field of the Invention

This invention relates to a photographic processing method and tank for processing silver halide photosensitive material (often abbreviated herein as "photosensitive material").

2. Prior Art

Black-and-white photosensitive materials after exposure are processed through a series of steps including black-and-white development, fixation and washing and color photosensitive materials after exposure are processed through a series of steps including color development, desilvering, washing and stabilization. There are used black-and-white developer for black-and-white development, fixer for fixation, color developer for color development, bleaching, blix and fixing solutions for desilvering, city water or deionized water for washing, and stabilizer for stabilization. Photosensitive materials are generally processed by dipping them in the respective solutions which are normally adjusted to a temperature of 20 to 50° C.

Among these steps, the developing step is a step wherein a developing agent which is a reducing agent acts on exposed silver halide grains in the photographic emulsion for reducing $Ag^+$ into Ag. Silver images are created in this way in black-and-white photography. In the case of color photography, an oxidant of color developing agent reacts with a coupler to form a dye image corresponding to a silver image. The developers experience a lowering of developing power due to deterioration by air oxidation during quiescent periods or the like. It is believed that the developing power is lost mainly because the developing agents and preservatives therefor are oxidized.

For avoiding such developer deterioration, a typical prior art approach is to replenish an increased amount of developer. Increased replenishment, however, results in increased usage of chemical agents and water, which is undesirable particularly from the standpoint of environmental protection requiring resource saving and waste liquid reduction. Further, since color developing agents are expensive, their increased consumption is against economy.

Subsequent to the color development step in the color photography is carried out a desilvering step, which involves several modes of performing bleaching and fixing steps in a common bath or separate baths, or performing bleaching and bleach-fixing steps in separate baths. The mode of performing bleaching and fixing steps in separate baths has the advantage of stable processing. The mode of performing bleaching and bleach-fixing steps in separate baths draws attention because of promoted desilvering (see Japanese Patent Application Kokai=JP-A 75352/1986).

Used in the bleaching step are bleaching solutions which contain bleaching agents or oxidizing agents. Exemplary bleaching agents are ferric complexes of aminopolycarboxylic acids and aminopolyphosphonic acids or their salts. Among others, ferric ethylenediaminetetraacetate complex is most often used while ferric 1,3-diaminopropanetetraacetate complex and analogs are also known as having high oxidizing power.

In the bleaching step, the silver resulting from the color development step undergoes oxidation reaction under the action of the bleaching agent which is an oxidizing agent while the bleaching agent itself is reduced. Therefore, the bleaching solution lowers its bleaching or oxidizing power as photosensitive materials are processed. A significant loss of oxidizing power occurs particularly when processing a great amount of photosensitive material or over-exposed photosensitive material.

The oxidizing power of bleaching agents can be restored, for example, by aerating the bleaching solution to increase the redox potential thereof. The aeration method, however, can introduce bubbles in the solution, bringing the problems that the bubbling solution can spill out of the bleaching tank contaminating the surroundings and that bubbles can splash over an adjacent tank contaminating the solution therein. The latter problem becomes more serious if the solution in the adjacent tank is a color developer as is often the case, because such entrainment causes the color developer to deteriorate and lower its developing power.

In the fixer is contained a fixing agent for dissolving the silver which has been oxidized by the bleaching agent. The fixing agent and preservatives therefor in the fixer are prone to oxidation with time during quiescent periods when no photosensitive material is processed. Once oxidized, these agents can decompose into sulfides which would cause sulfidation problems including photosensitive material surface contamination. Deficient fixation or desilvering is also a problem. These problems associated with oxidation are aggravated by entrainment of bleaching solution by the traveling photosensitive material.

The above-mentioned sulfide formation and deficient fixation problems occur likewise in fixers for black-and-white photography.

Heretofore, these problems were overcome in both black-and-white and color photography by increasing the amount of fixer replenished. However, increased replenishment is undesirable in view of resource saving and used solution disposal as previously described. Processing solutions containing bleaching or fixing agents commonly suffered from the above-mentioned problems associated with desilvering step.

SUMMARY OF THE INVENTION

A primary object of the present invention is to provide a photographic processing method and tank capable of easy maintenance and control of processing solution for adequate performance and capable of reducing the amount of processing solution replenished while producing images of high photographic quality. Another object of the present invention is to provide a photographic processing method and tank capable of diminishing waste liquid load.

These and other objects are achieved in accordance with one form of the present invention by a photographic processing method comprising the steps of developing a silver halide photosensitive material after exposure with a developer solution and then processing the material with a processing solution having bleaching function and/or a processing solution having fixing function while placing the developer solution and/or the processing solution having fixing function in contact with the other processing solution and/or an electrolyte solution through an anion exchange membrane. A cathode is placed in the developer solution and/or the processing solution having fixing function and an anode is placed in the other processing solution and/or the electrolyte solution for conducting electricity between the cathode and the anode.

In another form of the present invention, the processing solution having bleaching function is in contact with the other processing solution and/or an electrolyte solution through an anion exchange membrane. An anode is placed in the processing solution having bleaching function and a cathode is placed in the other processing solution and/or the electrolyte solution for conducting electricity between the cathode and the anode.

Developers such as color developers deteriorate in performance as photosensitive material is processed therewith because halogens are dissolved out into the developers. Electric conduction treatment in accordance with the amount of photosensitive material processed can remove the halogens. Also, oxidized products of color developing agents which do not participate in coupling reaction, oxidized products of black-and-white developing agents, and some preservatives are reduced at the cathode surface during electric conduction. Therefore, developing agents such as color developing agents and preservatives which have undergone air oxidation during quiescent periods are reduced at the electrode surface to restore their developing power, thus allowing formation of images with satisfactory density and deterring sensitivity lowering and gradation softening.

In processing solutions having bleaching function, bleaching agents which have been reduced by the processing of color photosensitive material are again oxidized by electric conduction to restore their bleaching power, thus deterring occurrence of deficient color recovery and deficient desilvering.

In a further form of the present invention, a silver halide photosensitive material, after exposure and development, is processed with a processing solution having bleaching function and then with a processing solution having fixing function, while placing the processing solution having bleaching function and the other processing solution or an electrolyte solution in contact through an ion exchange membrane, immersing a cathode in the processing solution having bleaching function and an anode in the other processing solution or the electrolyte solution, and conducting electricity across the electrodes. During electric conduction, reaction takes place in the solution having fixing function such that fixing agents and preservatives which have undergone air oxidation during quiescent periods are reduced at the electrode surface to restore their fixing power. Silver deposits on the cathode, which also contributes to fixing power recovery. These reactions deter occurrence of deficient desilvering and sulfide formation.

In one embodiment, an anion exchange membrane intervenes between a color developer and a processing solution having bleaching function. A cathode is immersed in the color developer and an anode immersed in the solution having bleaching function. Electricity is conducted across the electrodes. Then, the color developer will restore developing power and the solution having bleaching function will restore bleaching power through the above-mentioned mechanisms. In addition, electric conduction causes halide ions such as $Br^-$ which have accumulated in the color developer as a result of development to selectively pass through the anion exchange membrane and migrate into the solution having bleaching function. The migration of halide ions prevents unnecessary halide ions from accumulating in the color developer, thus avoiding development inhibition. This also eliminates a need for removal of halide ions such as $Br^-$ by overflow means, thus enabling to decrease the replenishment amount without adversely affecting development. The solution having bleaching function receives halide ions so that halides such as re-halogenating agents and bleaching promoters may be replenished in decreased amounts or need not be replenished as the case may be.

Also contemplated is an embodiment wherein an electrolyte solution such as NaCl, NaBr, and NaI is interposed between a color developer and a processing solution having bleaching function, and anion exchange membranes intervene between respective two of the solutions. Electric conduction between the color developer and the solution having bleaching function in the arrangement will allow both the solutions to recover their processing ability and cause halide ions such as $Br^-$ which have accumulated in the color developer to selectively migrate into the solution having bleaching function as described above. At the same time, anions such as Cl–, Br– and I– in the electrolyte solution can migrate into the solution having bleaching function so that halide components may be replenished to the solution in smaller amounts or need not be replenished as the case may be. This arrangement allows the ion exchange membranes to have an extended effective life.

In a further embodiment, an anion exchange membrane intervenes between a processing solution having bleaching function and a processing solution having fixing function. An anode is immersed in the solution having bleaching function and a cathode immersed in the solution having fixing function for conducting electricity across the electrodes. Electric conduction in this arrangement allows the solutions having bleaching and fixing functions to recover bleaching and fixing abilities, respectively, and causes halide ions which have accumulated in the solution having fixing function, especially fixer as a result of fixation to selectively migrate into the solution having bleaching function. The migration of halide ions prevents unnecessary halide ions from accumulating in the fixer, thus avoiding fixation inhibition. Since silver deposits on the cathode from the fixer, the fixing agent is regenerated, thus enabling to decrease the amount of fixer replenished without adversely affecting fixation function. The solution having bleaching function receives halide ions so that halides may be replenished in smaller amounts or need not be replenished as the case may be. In this embodiment, an electrolyte solution such as NaCl solution may be interposed between the solution having bleaching function and the solution having fixing function, and anion exchange membranes intervene between respective two of the solutions.

Moreover, black-and-white photosensitive material after exposure is generally processed by a series of development and fixation steps. A diaphragm which is at least partially composed of an anion exchange membrane intervenes between the black-and-white developer and the fixer. If desired, an electrolyte solution such as NaCl solution is interposed between the black-and-white developer and the fixer, and diaphragms, which are each at least partially composed of an anion exchange membrane, intervene between the black-and-white developer and the electrolyte solution and between the fixer and the electrolyte solution, respectively. Cathodes are immersed in the black-and-white developer and the fixer and an anode immersed in the electrolyte solution for conducting electricity across the electrodes. The electric conduction can eliminate inhibited development in the black-and-white developer because halide ions which have accumulated in the developer with the progress of development will selectively pass through the anion exchange membrane to migrate into the electrolyte solution and eventually into the fixer. The developing agents and preservatives which have undergone air oxidation during quiescent periods are reduced at the electrode surface to provide the developer with restored developing power so that developer replenishment may be decreased.

Preferably, the tanks are arranged such that an effluent of the developer resulting from replenishment is channeled to the electrolyte solution in an overflow manner. Then the developer effluent is brought into contact with the anode whereby the developing agent such as hydroquinone is oxidatively decomposed, resulting in the developer effluent having a low COD value. The same benefit is available with the color developer by adopting the same arrangement. In general, black-and-white developer is susceptible to silver staining or sludging due to the substantial presence of a sulfite salt which is contained as a preservative and can also serve as a solvent for silver halide. Immersion of a cathode in the black-and-white developer eliminates silver sludging in the developing tank since silver can be deposited on the cathode.

The fixer also restores fixing power. As in the preceding embodiments, electric conduction allows halide ions accumulating from repetitive fixation process to migrate into the electrolyte solution through the anion exchange membrane, and causes silver to deposit on the cathode so that the silver can be taken out of the system in the form of silver thiosulfate. Consequently, the fixing agent is regenerated and the fixer replenishment may be substantially decreased.

As in the case of the developer, the tanks are arranged such that an effluent of the fixer resulting from replenishment is channeled to the electrolyte solution. Then the fixer effluent is brought into contact with the anode whereby the fixing agent such as thiosulfate is oxidatively decomposed, resulting in the fixer effluent having a low COD value. The same benefit is available with the fixer used in the processing of color photosensitive material by adopting the same arrangement.

A plurality of processing solutions may be regenerated through electric conduction by arranging a tank filled with an electrolyte solution in juxtaposition to each of the processing tanks through an ion exchange membrane and conducting electricity between each pair of processing tank and electrolyte solution tank. Then regeneration of each tank is more precisely controlled. The electrolyte solution tanks joined to a plurality of tanks may be a common single tank if desired.

For providing liquid-junction for electric conduction purposes, an ion exchange membrane intervenes between processing solutions where electrodes are immersed or between a processing solution and an electrolyte solution where electrodes are immersed in the foregoing embodiments. It is also possible to use a salt bridge provide liquid-junction. However, use of a salt bridge without an ion exchange membrane is less desirable. The salt bridge has many drawbacks including high liquid resistance, high power consumption, difficulty to increase the liquid temperature, less adaptability to the size of electric conduction means, increased cost, and cumbersome maintenance due to short life and frequent replacement. In addition, the salt bridge accomplishes less processing ability recovery and replenishment reduction because it is impossible to remove halide ions from the developing and fixing tanks.

It will be understood that a rinsing solution used for rinsing after fixation may be utilized as the electrolyte solution, resulting in a further reduction of waste liquid.

Heretofore, it was known to regenerate a bleaching solution and a fixer at the same time using an anion exchange membrane. Exemplary are systems for treating waste solution resulting from processing of reversal film as disclosed in Furukawa, Hiroshi, "Eiga Terebi Gijutu Kyokai Shi" (Journal of Motion Picture & Television Society), No. 254, page 34 (1973), Japanese Patent Publication=JP-B 1423/1976 and 50716/1980, and JP-A 33142/1983. These methods use a special regenerating apparatus separate from processing tanks and do not apply an anion exchange membrane directly to the tanks. The present invention using an anion exchange membrane directly attached to processing tanks is distinguishable from the prior art apparatus.

As mentioned above, the present invention ensures easy maintenance and control of processing solution for adequate performance and is capable of decreasing the amount of processing solution replenished.

DESCRIPTION OF THE PREFERRED EMBODIMENTS

Figure 1:
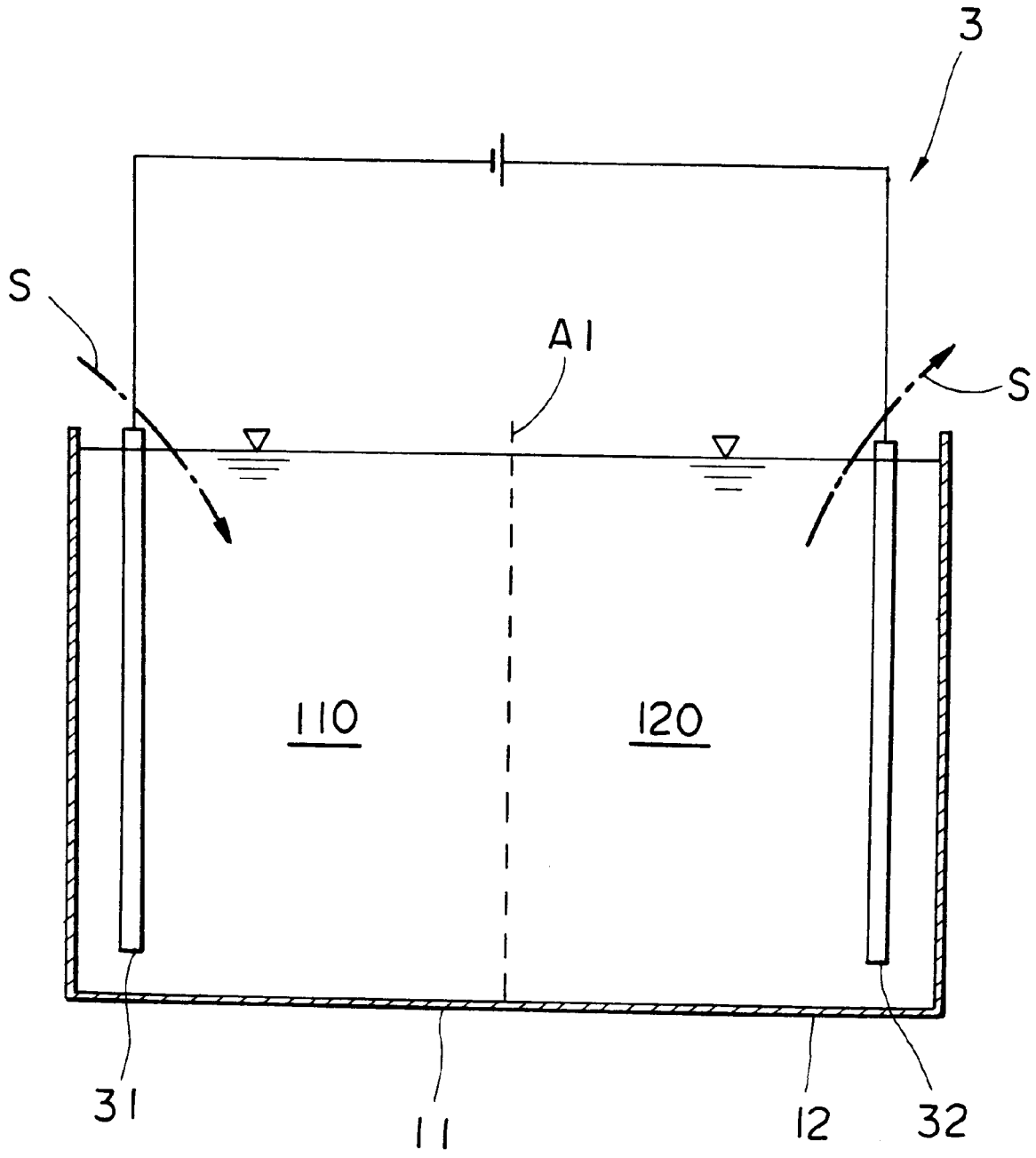
FIGS. 1 and 2 are schematic elevational views of processing systems according to the present invention.

The construction of the present invention will be described in detail.

In the practice of the present invention, color photosensitive material after exposure is processed by subjecting the material to color development with a color developer and then to desilvering with a processing solution having bleaching function. In a first embodiment, a developing tank filled with the color developer and a bleaching function tank filled with the solution having bleaching function are juxtaposed such that an anion exchange membrane intervenes between the developer and the solution having bleaching function. A cathode is placed in the developing tank and an anode placed in the bleaching function tank for conducting electricity across the electrodes.

Both a bleaching solution and a blix solution are included in the solution having bleaching function. The process proceeding from color development to desilvering steps includes the following procedures. (1) color development→bleaching→fixation (2) color development→bleaching washing→fixation (3) color development→bleaching→blix (4) color development→bleaching→blix→fixation (5) color development→blix→fixation (6) color development→blix→blix→fixation Among these, the first embodiment of the invention is preferably applicable to those procedures including color development→bleaching, procedures (1), (2), (3), and (4). For procedures (3) and (4), a cathode is preferably placed in the color developing tank and an anode placed in the bleaching tank. For procedure (5), an anode is preferably placed in the blix tank. For procedure (6), an anode may be placed in either of the blix tanks, preferably in a forward blix tank.

Now, the present invention is described as being applied to the representative procedure of color development→bleaching which is regarded preferred. FIG. 1 illustrates an exemplary arrangement of a processing system for use in practicing the representative procedure. As shown in FIG. 1, the processing system 3 includes a color developing tank 11 filled with a color developer 110 and a bleaching tank 12 filled with a bleaching solution 120 wherein a photosensitive material S is sequentially transferred through the color developing tank 11 and the bleaching tank whereby the material is subject to color development and bleaching.

A cathode 31 is disposed in the color developing tank 11 and an anode 32 disposed in the bleaching tank 12. As shown in the figure, the interface between the color developing tank 11 and the bleaching tank 12, that is, a diaphragm or partition intervening between the color developer 110 and the bleaching solution 120 is comprised of an anion exchange membrane Al. Also included is means for conducting electricity between the cathode 31 and the anode 32.

The arrangement shown in FIG. 1 is designed such that electric conduction across the electrodes 31, 32 is commenced upon receipt of a signal indicating the start of processing of photosensitive material S immediately or after the lapse of a predetermined time.

For electric conduction, voltage is applied so as to provide a current density of 0.05 to 100 $mA/cm^2$, preferably 0.2 to 30 $mA/cm^2$, especially 0.2 to 20 $mA/cm^2$. Preferred current density is 0.2 to 10 $mA/cm^2$ for color development, 0.5 to 15 $mA/cm^2$ for fixation, and 1 to 20 $mA/cm^2$ for blix. The applied voltage varies widely depending on the solution type, processing system form, electrode-to-electrode spacing, ion exchange membrane's quality, form, and type although it generally ranges from 0.05 to 100 V, preferably from 0.1 to 20 V, especially from 0.1 to 10 V.

Electric conduction recovers developing power and bleaching or oxidizing power. It provides an additional benefit that halide ions such as $Br^-$ which have accumulated in the color developer 110 migrate into the bleaching solution 120 through the anion exchange membrane Al. Since accumulation of halide ions in the color developer 110 is avoided, the development inhibition which would be otherwise induced by excess accumulation of halide ions is prevented. The bleaching solution 120, in turn, receives necessary halide ions so that the halide may be replenished in a smaller amount or need not be replenished as the case may be.

According to the present invention, electric conduction is preferably commenced at the start of processing and continued during the processing of photosensitive material because both the color developer and the bleaching solution can then maintain active ingredients at constant concentrations to thereby maintain their processing ability constant throughout the processing. Oxidative deterioration of the color developer becomes outstanding in a so-called occasional procedure wherein a small quantity of photosensitive material is processed (the amount of developer replenished relative to photosensitive material being processed per week is less than 0.3 the tank solution volume). The present invention carries out electric conduction immediately before or during processing for reducing oxygen in air which is entrained into the color developer by the photosensitive material during processing and for reducing the oxidized products of color developing agent resulting from reduction or development of silver halide during processing which are dissolved out into the color developer without reacting with the coupler, resulting in the color developing agent experiencing least deterioration.

Although an outstanding lowering of oxidizing power occurs in the bleaching solution when a large quantity of photosensitive material is processed (the amount of developer replenished relative to photosensitive material being processed per week is more than twice the tank solution volume), electric conduction during processing can maintain the oxidizing power constant. In general, the deterioration of the color developer becomes a serious problem in processing a small quantity of photosensitive material and the oxidative power lowering of the bleaching solution becomes a serious problem in processing a large quantity of photosensitive material. The present invention is effective for overcoming these problems and thus capable of maintaining optimum processing ability at all times regardless of processing conditions. Preferably, in the practice of the present invention, the redox potential of the bleaching solution 120 is measured at intervals during processing and electric conduction is controlledly turned on and off by applying voltage when the measured potential is below the predetermined level. It will be appreciated that the potential can be determined by measuring the anode potential relative to a standard hydrogen electrode or by using a redox potentiometer. The redox potential, which varies depending on the type of oxidizing agent, generally ranges from about 0 to about 210 mV for ferric ethylenediaminetetraacetate complex and from about 20 to about 260 mV for ferric 1,3-diaminopropanetetraacetate complex.

Thereafter, electric conduction is interrupted upon receipt of a signal indicating the completion of processing of photosensitive material S. As described above, the present invention uses simple electric means to maintain and control the processing ability of the color developer and bleaching solution. Therefore, the present invention can solve the developing power lowering of the color developer without resorting to the conventional method of increasing the amount of developer replenished. As to the bleaching solution, the prior art employed aeration for recovering the bleaching or oxidizing power of the bleaching agent with attendant problems that splashing bubbles of the solution could enter the color developer to deteriorate the latter and contaminate the surrounding components. The present invention is successful in not only overcoming these problems, but also introducing a re-halogenating agent electrochemically from without the bleaching system, thus diminishing its replenishment. Since the color developer and bleaching solution can maintain their processing ability, the present invention is successful in diminishing the replenishment of both the solutions. This results in an economical advantage particularly for the color developer because the amount of color developing agent used can be diminished.

Better results are obtained when the invention is applied to a procedure of color development immediately followed by desilvering as previously described because this procedure seriously suffers from the problem that aeration-induced splashing of the bleaching solution could contaminate and deteriorate the color developer.

The cathode used herein may be formed of electric conductors and semiconductors capable of long term service, with stainless steel being preferred. The anode may be formed of electric conductors which are insoluble, for example, carbon (graphite), lead dioxide, platinum, gold, and titanium steel while stainless steel is acceptable in some cases. The electrodes preferably take the form of plates, meshed plates or embossed plates adapted for easy installation in the tank. A proper size may be selected depending on the tank volume.

The material of anion exchange membrane will be described later in detail. The color developing and bleaching tanks may be formed of non-conductive resinous materials, for example, vinyl chloride, polyethylene, polyvinyl acetate, polyvinylidene chloride, ABS resins, phenolic resins, epoxy resins, and polystyrene. Although the color development→bleaching procedure has been illustrated in the embodiment of FIG. 1, a similar method may be applied to the remaining procedures mentioned above.

In the embodiment of FIG. 1 where the solution 110 in the tank 11 is a black-and-white developer, fixer or color developer, the solution 120 in the tank 12 may be changed to an electrolyte solution while a cathode is placed in the tank 110 and an anode placed in the tank 120. Inversely, where the solution 120 in the tank 12 is either a bleaching solution or a blix solution, the solution 110 in the tank 11 may be changed to an electrolyte solution while an anode is placed in the tank 120 and a cathode placed in the tank 110. In either case, the electrolyte solution may be an overflow of the corresponding solution or another solution.

The photosensitive material which has been subjected to color development and processing with a processing solution having bleaching function according to the present invention is then processed by a processing solution having fixing function as understood from the above-mentioned procedures. Included in the solution having fixing function are a fixer and a blix solution.

Likewise, the present invention is applicable to processing with a solution having bleaching function and to processing with a solution having fixing function by placing an anode in a bleaching function tank filled with the solution having bleaching function and a cathode in a fixing function tank filled with the solution having fixing function, interposing an anion exchange membrane between the solution having bleaching function and the solution having fixing function, and conducting electricity across the electrodes. Although the desilvering procedure involving both processing with a solution having bleaching function and processing with a solution having fixing function includes several procedures as previously mentioned, the present invention is preferably applied to desilvering procedure (1) or (2) among others. It is to be noted that for procedure (4), electrical liquid junction may be provided between the bleaching and blix tanks or between the blix and fixing tanks, or between the bleaching and fixing tanks, and electrodes may be placed in the respective tanks. For procedure (5), an anode may be placed in the blix tank. For procedure (6), an anode may be placed in a forwardly disposed one of the blix tanks, and electrodes placed in any appropriate two tanks chosen from the three tanks in accordance with the present invention.

Preferred procedures including color development and desilvering steps to which the present invention is applicable are the above-mentioned procedures (1) and (2). Now procedure (2) is illustrated as a representative one.

Figure 2:
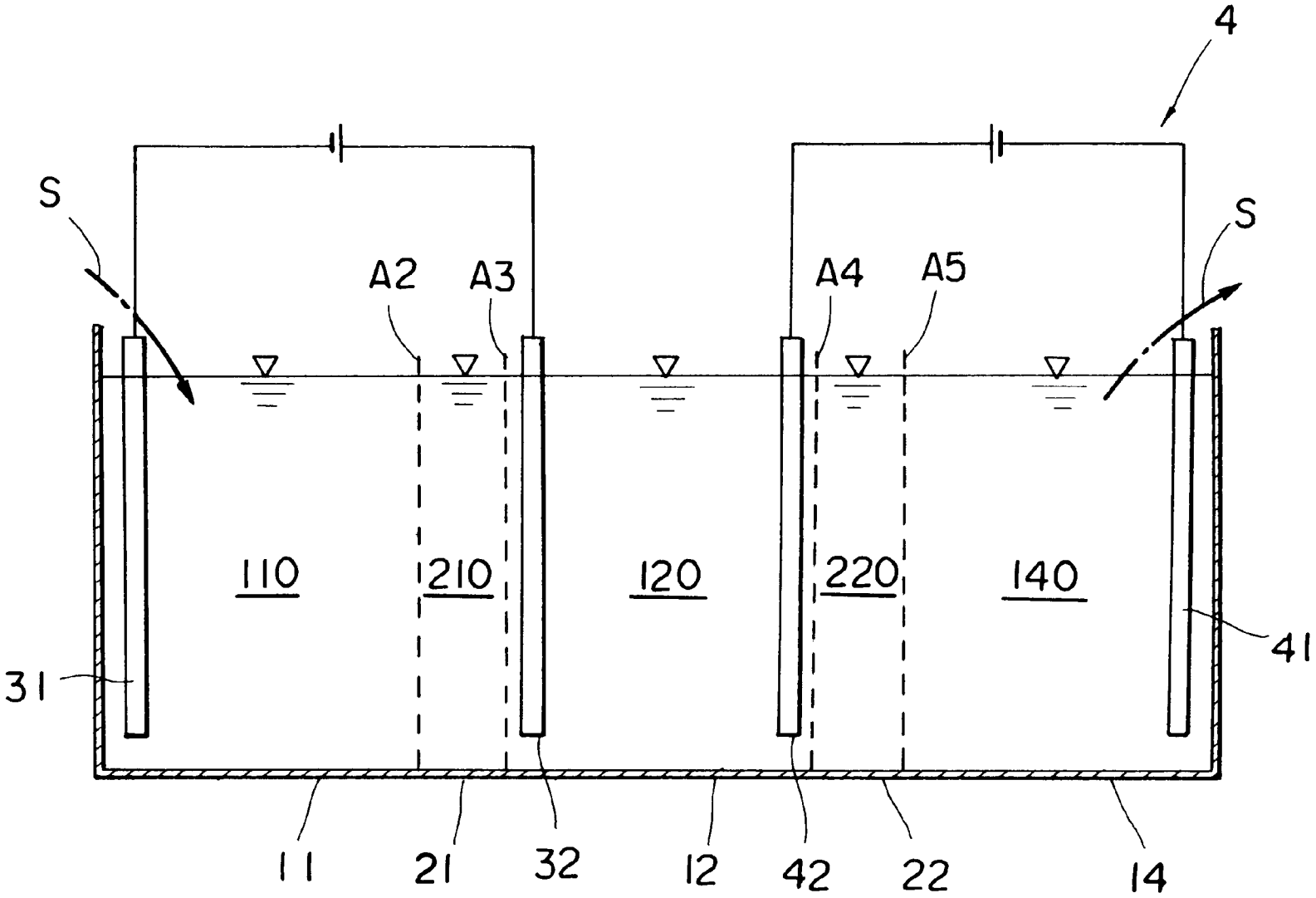

FIG. 2 illustrates one exemplary arrangement of a processing system for practicing procedure (2). As shown in FIG. 2, the processing system 4 includes a color developing tank 11 filled with a color developer 110, a bleaching tank 12 filled with a bleaching solution 120, and a fixing tank 14 filled with a fixer 140. A solution tank 21 filled with an electrolyte solution 210 is interposed between the color developing tank 11 and the bleaching tank 12, and another solution tank 22 filled with an electrolyte solution 220 is interposed between the bleaching tank 12 and the fixing tank 14. Diaphragms intervening between the color developer 110 and electrolyte solution 210, between the electrolyte solution 210 and bleaching solution 120, between the bleaching solution 120 and electrolyte solution 220, and between the electrolyte solution 220 and fixer 140 are anion exchange membranes A2, A3, A4, and A5, respectively.

There are installed a cathode 31 in the color developing tank 11, anodes 32, 42 in the bleaching tank 12, and a cathode 41 in the fixing tank 14. Also provided are means for conducting electricity across the electrodes 31, 32 and 41, 42. Although separate anodes 32, 42 are installed in the bleaching tank 12 in the illustrated embodiment, a single electrode may be used instead.

In the arrangement shown in FIG. 2, electric conduction is commenced across the cathode 31 and anode 32 and across the cathode 41 and anode 42 upon receipt of a signal indicating the start of processing of photosensitive material S immediately or after the lapse of a predetermined time. Electric conduction is carried out in the same manner as previously described.

With this arrangement, the same results are obtained through the same mechanism as with the processing system of FIG. 1, and additionally, in the fixer 140, the fixing agent and preservative which have been air oxidized during quiescent periods are reduced, deterring a lowering of fixing power. The method of the invention is effective in restraining oxidation of the fixing and other agents which is otherwise promoted by the bleaching solution entrained by photosensitive material S. The method also prevents oxidative decomposition of the fixing agent and preservative, thus deterring sulfide formation.

Also, electric conduction is preferably commenced at the start of processing and continued during the processing of photosensitive material as in the processing system of FIG. 1. Then all the solutions including the fixer can then maintain their processing ability constant throughout the processing.

Oxidative deterioration of the fixer becomes outstanding in the so-called occasional procedure wherein a small quantity of photosensitive material is processed (the amount of fixer replenished relative to photosensitive material being processed per week is less than 0.3 times the tank solution volume) because part of the bleaching solution carried into the fixer during processing can take in oxygen from air with the lapse of time, thus promoting oxidation of the fixer. The present invention carries out electric conduction immediately before or during processing for establishing a reducing state in the fixer so that the fixer may be regenerated and withstand the entrainment of bleaching solution during processing. Therefore, although oxidative deterioration of the fixer might be otherwise serious in the occasional procedure, the present invention is effective in correcting the problems in the respective solutions and maintaining optimum processing ability regardless of processing conditions.

The present invention uses simple electric means to maintain and control the processing ability of the fixer too because silver ions of silver thiosulfate are deposited on the cathode in the fixer during electric conduction so that thiosulfate ions are generated again. This eliminates a need for increasing the fixer replenishment for overcoming a lowering of fixing power and allows the amount of fixer solution replenished to be diminished.

Accordingly, the FIG. 2 arrangement can regain the developing, bleaching, and fixing powers. More particularly, a benefit is obtained between the color developer 110 and bleaching solution 120 in that halide ions migrate therebetween through two anion exchange membranes A2, A3. Further, anions in the electrolyte solution 210 will migrate into the bleaching solution 120 through the anion exchange membrane A3. If the electrolyte in the electrolyte solution 210 is constituted by a desirable anion to be replenished to the bleaching solution 120, then the amount of said anion replenished can be diminished.

An additional benefit are obtained between the bleaching solution 120 and fixer 140 in that halide ions such as $Br^-$ accumulating in the fixer 140 during processing will migrate into the bleaching solution 120 through two anion exchange membranes A4, A5. Since accumulation of halide ions in the fixer 140 is avoided, the fixation inhibition which would be otherwise induced by excess accumulation of halide ions is prevented. The fixing agent is regenerated proximate to the cathode. The bleaching solution 120, in turn, is made up with necessary halide ions, even eliminating a need for additional replenishment. Like between the color developer 110 and bleaching solution 120, a benefit is obtained between the bleaching solution 120 and fixer 140 in that anions originating from the electrolyte solution 220 will migrate into the bleaching solution 120.

According to the present invention, the processing ability of color developing, bleaching, and fixing solutions is maintained and controlled by conducting electricity therebetween in the above-defined fashion. In the prior art, almost no disclosure is found proposing a method of recovering the developing power of color developer by electric conduction. But, it is known to recover silver from blix or fixing solution by electrolytically depositing silver on a cathode, while a diaphragm is interposed intermediate the cathode and anode for improving the percentage recovery of silver and preventing oxidative decomposition of the solution (see JP-A 73388/1980 and 69626/1981). However, it is unknown to maintain and control the processing ability of various processing solutions in accordance with the present invention by providing electric conduction between processing solutions of different types, for example, between a color developer and a bleaching solution and between a bleaching solution and a fixer or between a processing solution and an electrolyte solution as will be described later.

Any desired anion exchange membrane may be used in the present invention as long as it allows for selective passage of anions. Commercially available ones are acceptable. A particular type of anion exchange membrane may be selected depending on the valence of an anion which is desired to pass through the membrane. When it is desired to allow penetration of a halide ion such as $Br^-$ which would accumulate in the color developer or fixer, for example, it is recommended to use an anion exchange membrane which allow for selective passage of monovalent anions or ions having a molecular weight of less than about 100 or a molecular radius of less than about 100 Å.

Commercially available examples of the anion exchange membrane include Selemion AMV/AMR (manufactured by Asahi Glass K.K.), Aciplex A201 and A172 (manufactured by Asahi Chemicals K.K.), Neosepta AM-1, AM-2, and AM-3 (manufactured by Tokuyama Soda K.K.), Ionac MA-3148 (manufactured by Ionac Chemicals), and Nepton AR103PZL (manufactured by Ionics). Those anion exchange membranes allowing for selective passage of monovalent anions are commercially available as Selmion ASV/ASR (manufactured by Asahi Glass K.K.) and Neosepta AFN-7 and Neosepta ACS (manufactured by Tokuyama Soda K.K.). In the present disclosure, the anion exchange membrane is used to generally designate membranes capable of selective passage of anions and in this sense, encompasses porous ceramic materials having a pore diameter of 0.2 to 20 For delimiting a processing solution having bleaching function such as a bleaching solution, there may be used two or more anion exchange membranes or an anion exchange membrane combined with another membrane which does not allow for the passage of Fe(III)-EDTA used as a bleaching agent, for example, an anion exchange membrane capable of selective passage of monovalent anions having a molecular weight of less than about 200, especially less than about 100. Then, a processing solution containing Fe(III)-EDTA or similar agent having bleaching function is well partitioned such that migration of any desired components therefrom may be restrained.

The electrolyte solution charged between anion exchange membranes is not particularly limited. Preferred electrolytes are halides such as NaCl, KCl, LiCl, NaBr, KBr, and KI; sulfates such as $Na_2SO_4$ and $K_2SO_4$; nitrates such as $KNO_3$, $NaNO_3$, and $NH_4NO_3$; and 10 carbonates such as $Na_2CO_3$ and $K_2CO_3$.

Where halide electrolytes are used, the replenishment of a bleaching promoter or re-halogenating agent to the bleaching solution can be diminished or eliminated as the case may be. Use of nitrates results in replenishment of nitrate ions and thus diminishes or sometimes eliminates the replenishment of an anti-corrosion agent or bleaching promoter. Use of sulfates results in replenishment of sulfate ions and thus diminishes or sometimes eliminates the replenishment of an acid for pH lowering. Use of of carbonates results in replenishment of carbonate ions and thus diminishes or sometimes eliminates the replenishment of a pH buffer agent or acid.

The electrolyte solution may contain the electrolyte in a concentration of 0.001 to 30%, preferably 0.05 to 20%, especially 0.1 to 20%. Depending on a particular electrolyte solution used, an appropriate anion exchange membrane may be selected.

In either case, electric conduction is carried out during processing of photosensitive material and interrupted at the end of processing. It is preferred to provide electric conduction while measuring the redox potential of a solution having bleaching function. Moreover, the electricity quantity conducted may be either controlled in accordance with the quantity of photosensitive material processed or predetermined in accordance with a previously estimated quantity of photosensitive material to be processed.

Further, the arrangement of FIG. 2 may be used in another way by using a black-and-white developer as solution 110 in tank 11, a fixer as solution 140 in tank 14, an electrolyte solution as solution 120 in tank 120, electrolyte solutions as solutions 210, 220 in tanks 21, 22 and placing cathodes in solutions 110, 140 and anodes in solution 120.

It will be understood that although an anion exchange membrane is installed in the main tank in the arrangements of FIGS. 1 and 2, it is possible to install an anion exchange membrane in an auxiliary tank connected to the main tank for communication of processing solution so that the membrane delimits the solution. Also, anion exchange membranes may be installed in both between main tanks and auxiliary tanks or a similar arrangement may be used between auxiliary tanks.

Figure 3:
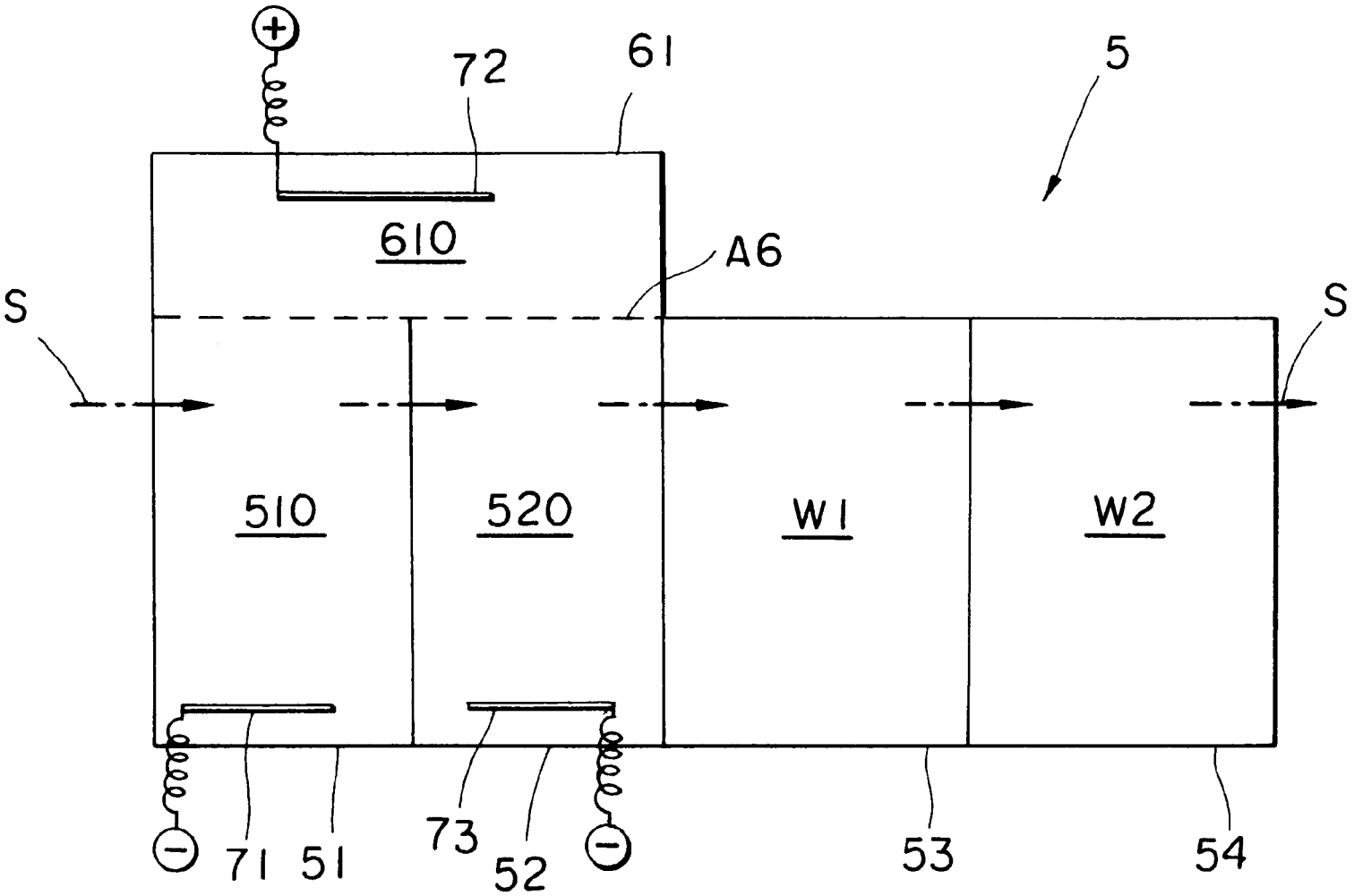
FIGS. 3, 4, 5, and 6 are schematic plan views of the tank arrangements of different processing systems according to the present invention.

Especially when a black-and-white photosensitive material is processed in the practice of the present invention, an arrangement as shown in FIG. 3 may be used for maintaining and controlling the processing ability of respective processing solutions. FIG. 3 is a plan view showing the arrangement of processing tanks. As shown in FIG. 3, the processing system 5 includes a developing tank 51 filled with a black-and-white developer 510, a fixing tank 52 filled with a fixer 520, and washing tanks 53, 54 filled with wash waters W1, W2 wherein a black-and-white photosensitive material is subject to a series of steps: black-and-white development→fixation→washing→washing.

Also the processing system 5 includes a tank 61 filled with an electrolyte solution 610 disposed in juxtaposition with the developing tank 51 and fixing tank 52, and an anion exchange membrane A6 constitutes a diaphragm intervening between the black-and-white developer 510 or fixer 520 and the electrolyte solution 610. Cathodes 71 and 73 are placed in the developing and fixing tanks 51 and 52, respectively, and an anode 72 is placed in the solution tank 61. There is provided means for conducting electricity across the electrodes 71 to 73. As in the preceding embodiments, electric conduction across the electrodes 71 to 73 is commenced upon receipt of a signal indicating the start of processing of photosensitive material S immediately or after the lapse of a predetermined time.

Such electric conduction allows the developer and fixer to restore the developing and fixing powers, respectively, through the same mechanism as previously described for the color photosensitive material. Electric conduction also causes halide ions such as $Br^-$ resulting from development or fixation treatment to migrate into the electrolyte solution 610 through the anion exchange membrane A6. This prevents accumulation of such ions in the developer or fixer which would otherwise cause development or fixation inhibition. Especially in the fixer, silver thiosulfate is reduced so that silver ions are deposited on the cathode and thiosulfate ions are regenerated. Therefore, the amount of processing solution replenished can be decreased.

Further, although the black-and-white developer is susceptible to silver sludging due to a relatively high content of sulfite preservative, deposition of silver on the cathode prevents occurrence of silver sludging. Deposition of silver on the cathode also occurs in the fixer, enabling silver recovery.

Figure 4:
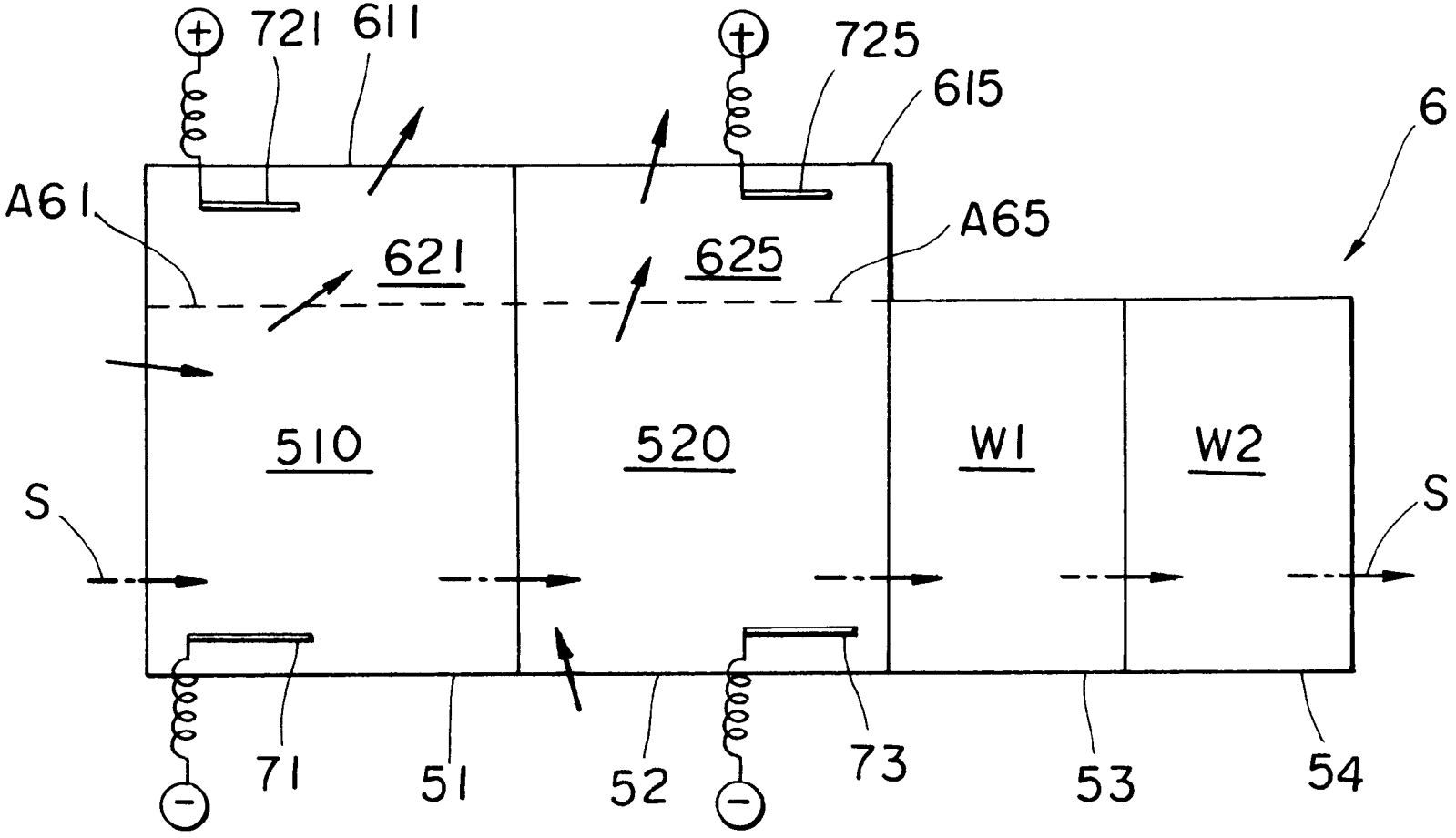

FIG. 4 shows a further processing system 6 which includes solution tanks 611 and 615 disposed in juxtaposition with a developing tank 51 and a fixing tank 52, respectively. Also included are an anion exchange membrane A61 intervening between a black-and-white developer 510 and an electrolyte solution 621, another anion exchange membrane A65 intervening between a fixer 520 and an electrolyte solution 625, and anodes 721, 725 in the solution tanks 611, 615. Electricity is conducted across the cathodes 71, 73 and anodes 721, 725. This arrangement enables more easy and precise maintenance and control of the processing ability of the respective processing tanks. Preferably in this arrangement, the solution surface in the black-and-white developing tank 51 is at a higher level than the solution surface in the solution tank 611 whereby an overflow from the black-and-white developing tank 51 enters the solution tank 611. A similar relation is preferably established between the fixing tank 52 and the solution tank 615. With this design, an overflow of the black-and-white developer 510 enters the solution tank 611 where the developing agent such as hydroquinone is subject to oxidative decomposition into formic acid and acetic acid, resulting in a lowering of COD and a lowering of waste liquid disposal load therewith. Also, an overflow of the fixer 520 enters the solution tank 615 where the fixing agent such as thiosulfate is subject to oxidative decomposition into a more biodecomposable form, resulting in a lowering of COD and a lowering of waste liquid disposal load therewith.

Figure 5:
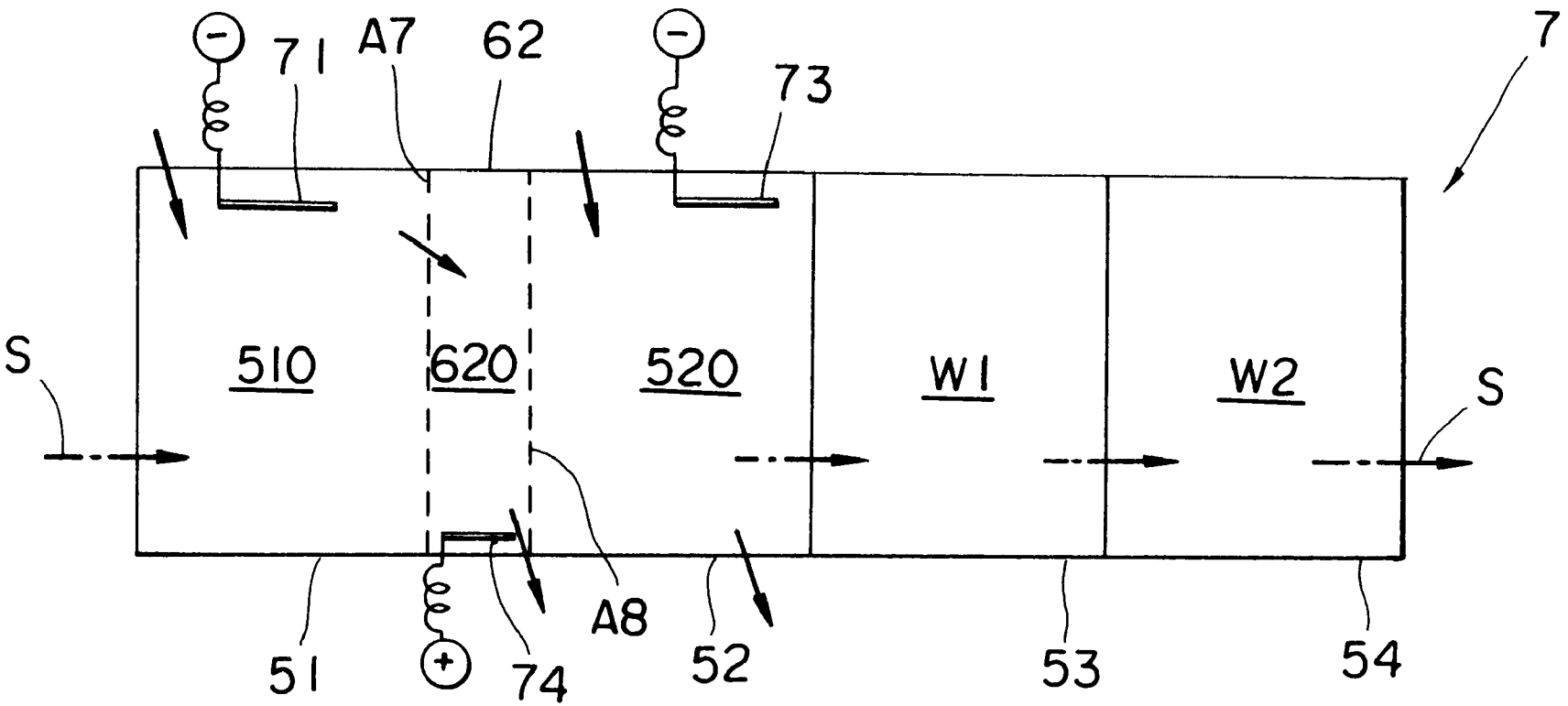

Further acceptable is a processing system 7 as shown in FIG. 5. The arrangement of FIG. 5 is obtained by modifying the arrangement of FIG. 3 such that a solution tank 62 is interposed between the developing and fixing tanks 51 and 52. Included are an anion exchange membrane A7 intervening between a black-and-white developer 510 and an electrolyte solution 620, another anion exchange membrane A8 intervening between a fixer 520 and the electrolyte solution 620, an anode 74 installed in the solution tank 62, and means for conducting electricity across the cathodes 71, 73 and anode 74. Also preferably in this arrangement, the tanks are designed such that an overflow from the black-and-white developing tank 51 enters the solution tank 62, resulting in a lowering of waste liquid load as in the arrangement of FIG. 6. It is to be noted that in the arrangement of FIG. 5, the photosensitive material S is conveyed along a path such that it is not dipped in the electrolyte solution 620 in tank 62.

Figure 6:
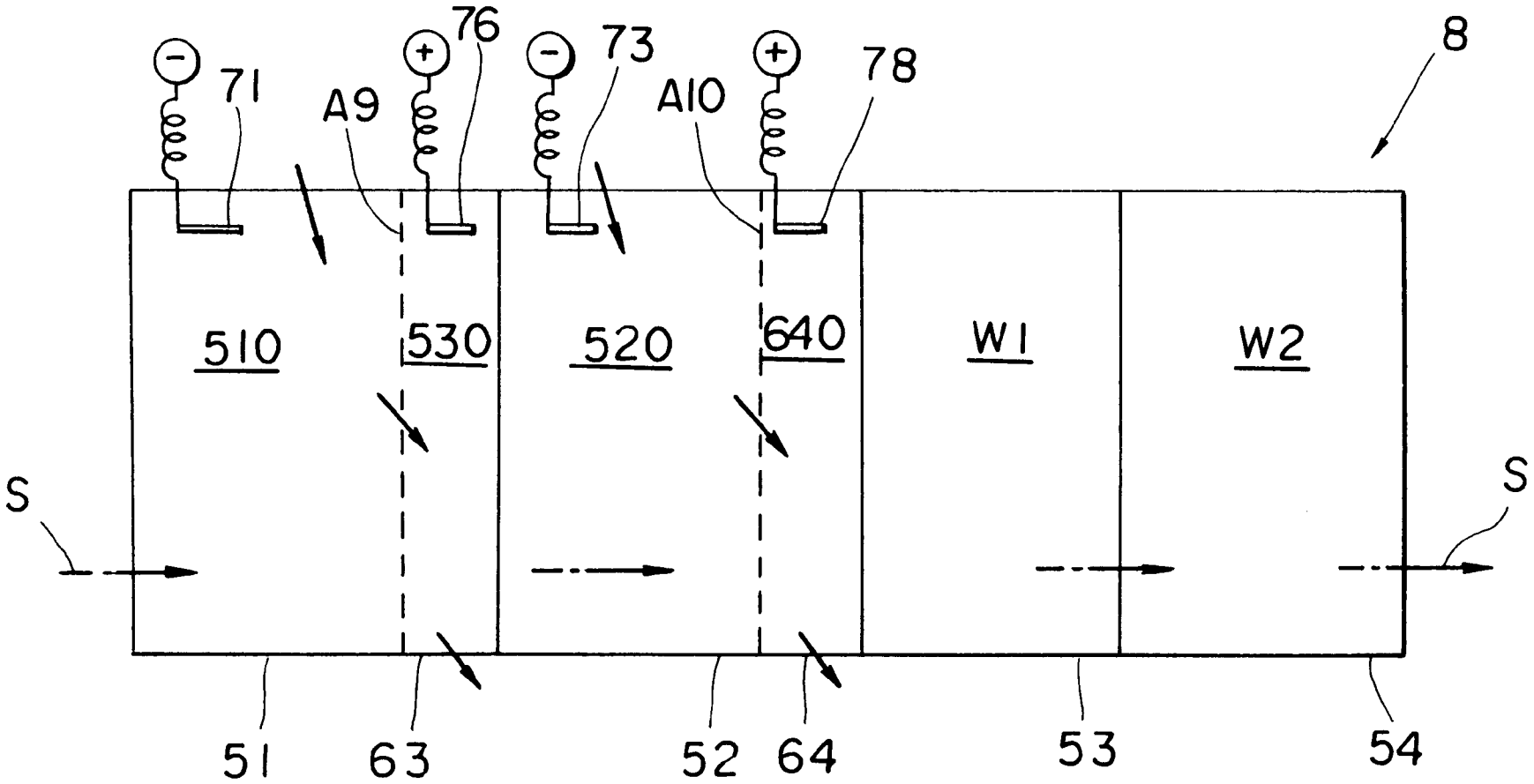

Further acceptable is a processing system 8 as shown in FIG. 6. The arrangement of FIG. 6 is obtained by modifying the arrangement of FIG. 5 such that solution tanks 63 and 64 are interposed between the developing and fixing tanks 51 and 52 and between the fixing and washing tanks 52 and 53, respectively. Included are an anion exchange membrane A9 intervening between a black-and-white developer 510 and an electrolyte solution 630, another anion exchange membrane A10 intervening between a fixer 520 and an electrolyte solution 640, and anodes 74, 76 installed in the solution tanks 63, 64.

Also in this arrangement, the photosensitive material S is conveyed along a path such that it is not dipped in the electrolyte solutions 630, 640 in tanks 63, 64.

Also preferably in this arrangement, the tanks are designed such that an overflow from the developing tank 51 enters the solution tank 63 and an overflow from the fixing tank 52 enters the solution tank 64, resulting in a lowering of waste liquid load for the black-and-white developer 510 and fixer 520 as in the preceding arrangements.

Figure 7A:
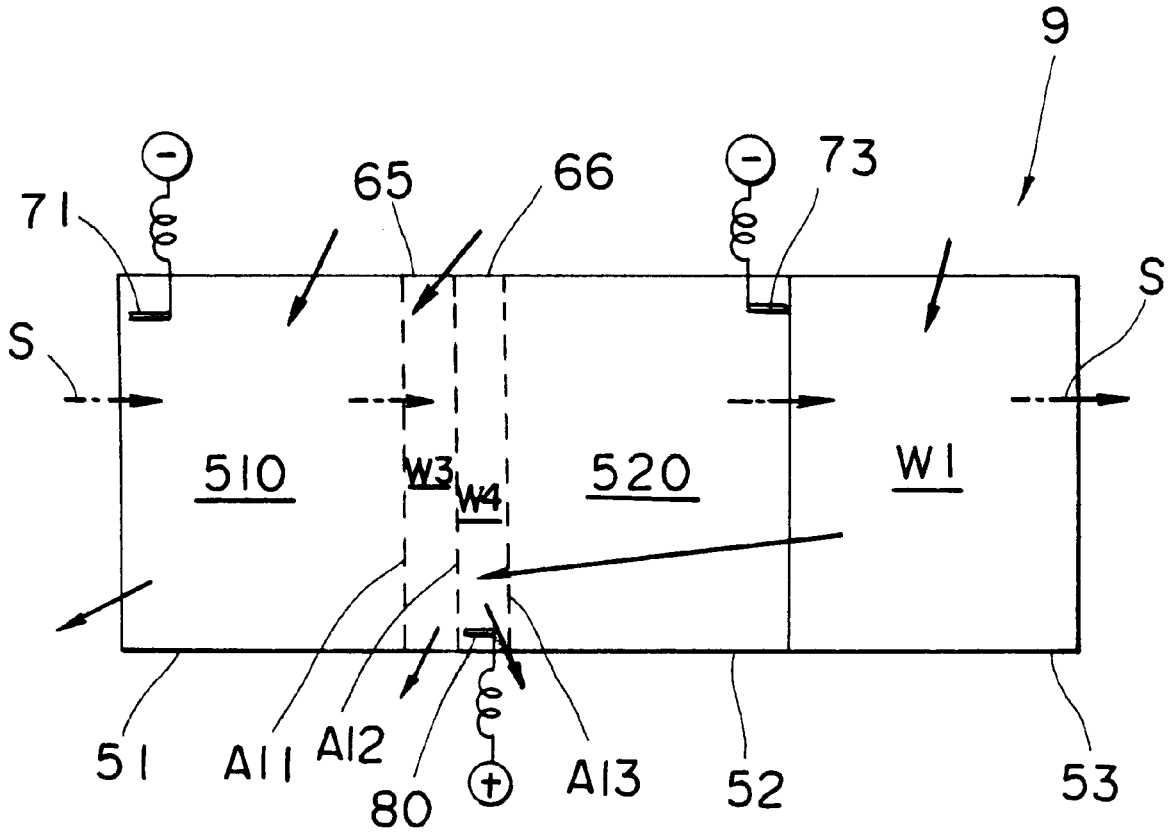
FIG. 7 schematically illustrates the tank arrangement of a further processing system according to the present invention, FIGS. 7*a* and 7*b* being plan and elevational views.

Newly prepared electrolyte solutions are used in the foregoing embodiments although washing water may be utilized as the electrolyte solution. One exemplary system for utilizing washing water is a processing system 9 of the arrangement shown in FIGS. 7*a* and 7*b*. FIG. 7*a* is a plan view schematically showing a tank arrangement and FIG. 7*b* is a cross sectional elevation thereof.

As shown in FIG. 7, the processing system 9 includes a developing tank 51 filled with a black-and-white developer 510, a washing tank 65 filled with wash water W3, another washing tank 66 filled with wash water W4, a fixing tank 52 filled with a fixer 520, and a further washing tank 53 filled with wash water W1 wherein a photosensitive material S is subject to a series of steps: development→washing→fixation→washing. Cathodes 71 and 73 are placed in the developing and fixing tanks 51 and 52, respectively, and an anode 80 is placed in the washing tank 66. There is provided means for conducting electricity across the electrodes. Anion exchange membranes A11, A12, and A13 constitute diaphragms intervening between black-and-white developer 510 and wash water W3, between wash waters W3 and W4, and between wash water W4 and fixer 520, respectively.

Figure 7B:
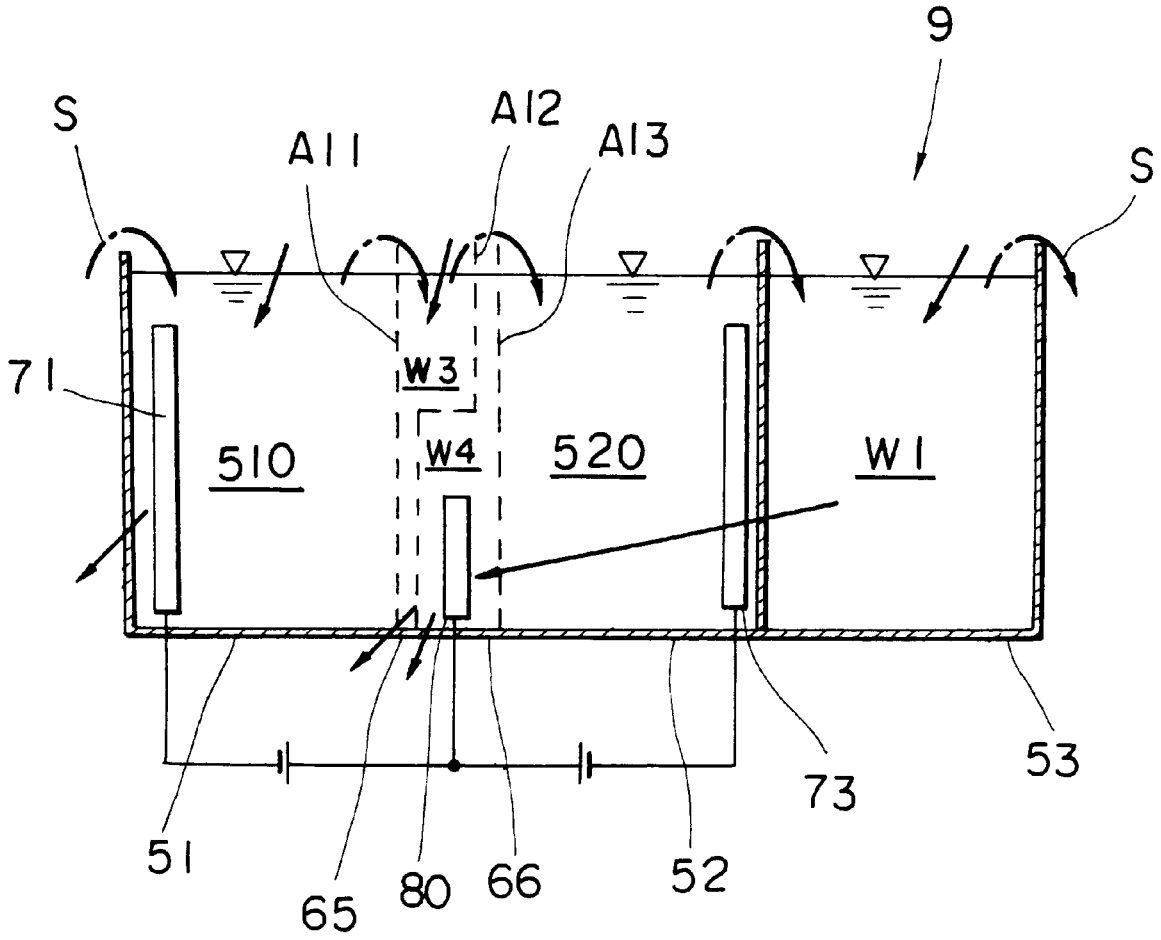

The washing tank 66 having the anode 80 installed therein is not intended for the immersion processing of photosensitive material S, and as best shown in FIG. 7*b*, the washing tanks 65 and 66 are staggered such that they are partially stacked through the anion exchange membrane A12.

Flow lines are arranged such that an overflow of wash water W1 in the washing tank 53 enters the washing tank 66, an overflow from the washing tank 66 is independently discharged, and an overflow from the washing tank 65 enters the developing tank 51.

As in the preceding embodiments, electric conduction takes place in the arrangement of FIGS. 7*a* and 7*b*.

Such electric conduction allows the developer and fixer to restore the developing and fixing powers, respectively, through the same mechanism as previously described. The wash water W4 acts in the same manner as the previously described electrolyte solution in that unnecessary halide ions accumulating in the black-and-white developer 510 and fixer 520 during processing migrate into wash water W4 through the anion exchange membranes A11 and A13 and are then discharged from the washing tank 66 along with an overflow therefrom, resulting in little accumulation of halide ions so that processing abilities are well maintained.

Electric condition across wash water W3 in the washing tank 65 becomes possible since developer components are entrained therein by photosensitive material S so that electrolytes are present in the wash water. Halogens accumulating in the developer 510 migrate into wash water W4 in the washing tank 66 through the anion exchange membranes A11 and A12. Likewise, during electric conduction, halogens accumulating in the fixer 520 migrate into wash water W4 in the washing tank 66 through the anion exchange membrane A13. These halogens would cause development and fixation inhibition if left accumulated, but since the halogens are moved to wash water W4 outside the developing and fixing tanks, the respective solutions can maintain their activity. The halogens thus accumulating in wash water W4 are discharged out of the washing tank 66 in an overflow manner as an overflow of wash water WI enters the washing tank 66.

It will be understood that similar results are obtained by modifying the arrangement of FIG. 7 such that an overflow of developer 510 is used instead of wash water W3. This ensures high sensitivity processing due to washing with a halogen rich developer.

Figure 8:
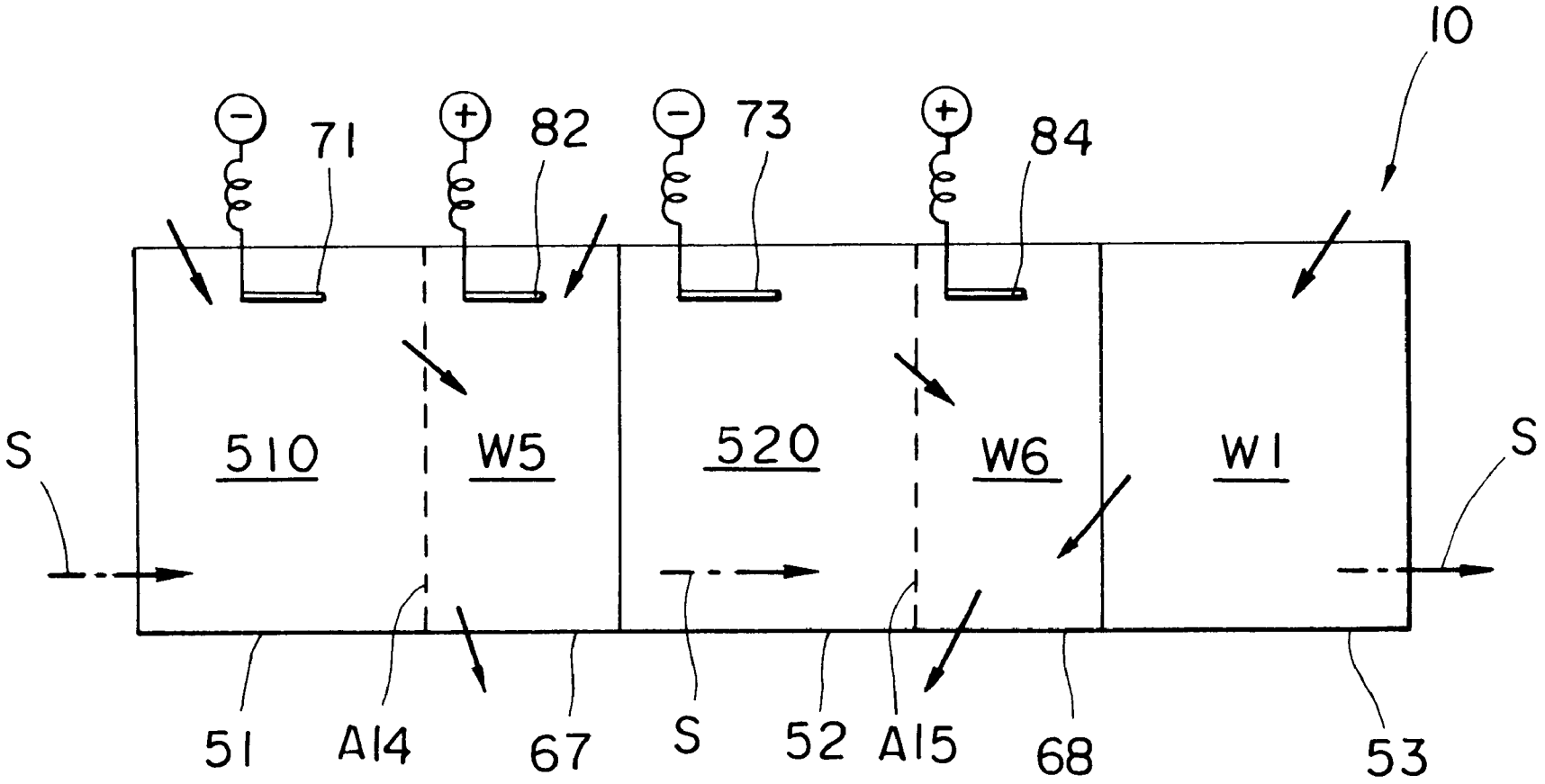
FIGS. 8, 9, and 10 are schematic plan views of the tank arrangements of still further processing systems according to the present invention.

Use of wash water as an electrolyte solution is also enabled by a processing system 10 of the arrangement shown in FIG. 8. FIG. 8 is a plan view showing a tank arrangement. As shown in FIG. 8, the processing system 10 includes a developing tank 51 filled with a black-and-white developer 510, a washing tank 67 filled with wash water W5 serving as an electrolyte solution, a fixing tank 52 filled with a fixer 520, another washing tank 68 filled with wash water W6 serving as an electrolyte solution, and a further washing tank 53 filled with wash water WI wherein a photosensitive material S is subject to a series of steps: development→fixation→washing. Anion exchange membranes A14 and A15 constitute diaphragms intervening between black-and-white developer 510 and wash water W5 and between fixer 520 and wash water W6, respectively.

Cathodes 71 and 73 are placed in the developing and fixing tanks 51 and 52, and anodes 82, 84 placed in the washing tanks 67, 68, respectively. There is provided means for conducting electricity across the electrodes.

Further, the tanks are designed such that an overflow from the developing tank 51 enters the washing tank 67, an overflow from which is discharged outside, and an overflow from the fixing tank 52 enters the washing tank 68, an overflow from which is discharged outside. Moreover, an overflow from the washing tank 53 enters the washing tank 68 situated forward thereof. The reason why this flow circuit is possible is that because the developer and the fixer are regenerated, the amount of the respective solutions replenished can be diminished and as a result, the developer and fixer overflows are of reduced flow rate. Then wash waters W5 and W6 have smaller COD loads and chemical substances are oxidized at the anodes.

Electric conduction allows the developer and fixer to restore the developing and fixing powers, respectively, through the same mechanism as previously described. The wash waters W5 and W6 act in the same manner as the previously described electrolyte solution in that halide ions accumulating in the black-and-white developer 510 during processing migrate into wash water W5 through the anion exchange membrane A14 and halide ions accumulating in the fixer 520 during processing migrate into wash water W6 through the anion exchange membrane A15. As a result, development or fixation inhibition caused by halide ions is deterred.

Since an overflow of the black-and-white developer 510 and an overflow of the fixer 520 are oxidized at the anodes 82, 84 before they are discharged outside, there results a lowering of waste liquid loads. An overflow of wash water W1 is reused in the washing tank 68, also resulting in a lowering of waste liquid load.

Electrolyte solutions are newly prepared or the processing solutions are mixed with washing water in the foregoing embodiments although rinsing liquid may be utilized as the electrolyte solution. One exemplary system for utilizing rinsing liquid is a processing system 30 of the arrangement shown in FIG. 9. The processing system 30 of FIG. 9 additionally includes a first rinsing tank 53 filled with rinsing liquid RI, a second rinsing tank 54 filled with rinsing liquid R2, and a third rinsing tank 55 filled with rinsing liquid R3 serially disposed behind the fixing tank 52 wherein a photosensitive material S is subject to a series of steps: development→fixation→rinsing→rinsing→rinsing.

This arrangement adopts a multi-stage counterflow system for rinsing that, as shown by arrows, rinsing liquid is replenished to the third rinsing tank 55, an overflow from the third rinsing tank 55 enters the second rinsing tank 54, and an overflow from the second rinsing tank 54 enters the first rinsing tank 53. An overflow from the first rinsing tank 53 enters an electrolyte solution tank 62 so that the used rinsing liquid R1 is utilized as an electrolyte solution 630. The electrolyte solution 630 initially charged in the solution tank 62 may be either a discharge of the rinsing liquid R1 or a separately prepared one.

Even when deionized water is used as the rinsing liquid, the rinsing liquid, once used, can have a salt or fixer component entrained by the photosensitive material S. Then such rinsing liquid can be used as the electrolyte solution without a problem, resulting in a reduction of waste liquid volume. The rinsing liquid may be conventional one, preferably having added thereto bactericidal agents, antifungal agents, dye leaching agents, decoloring agents and the like.

Figure 9:
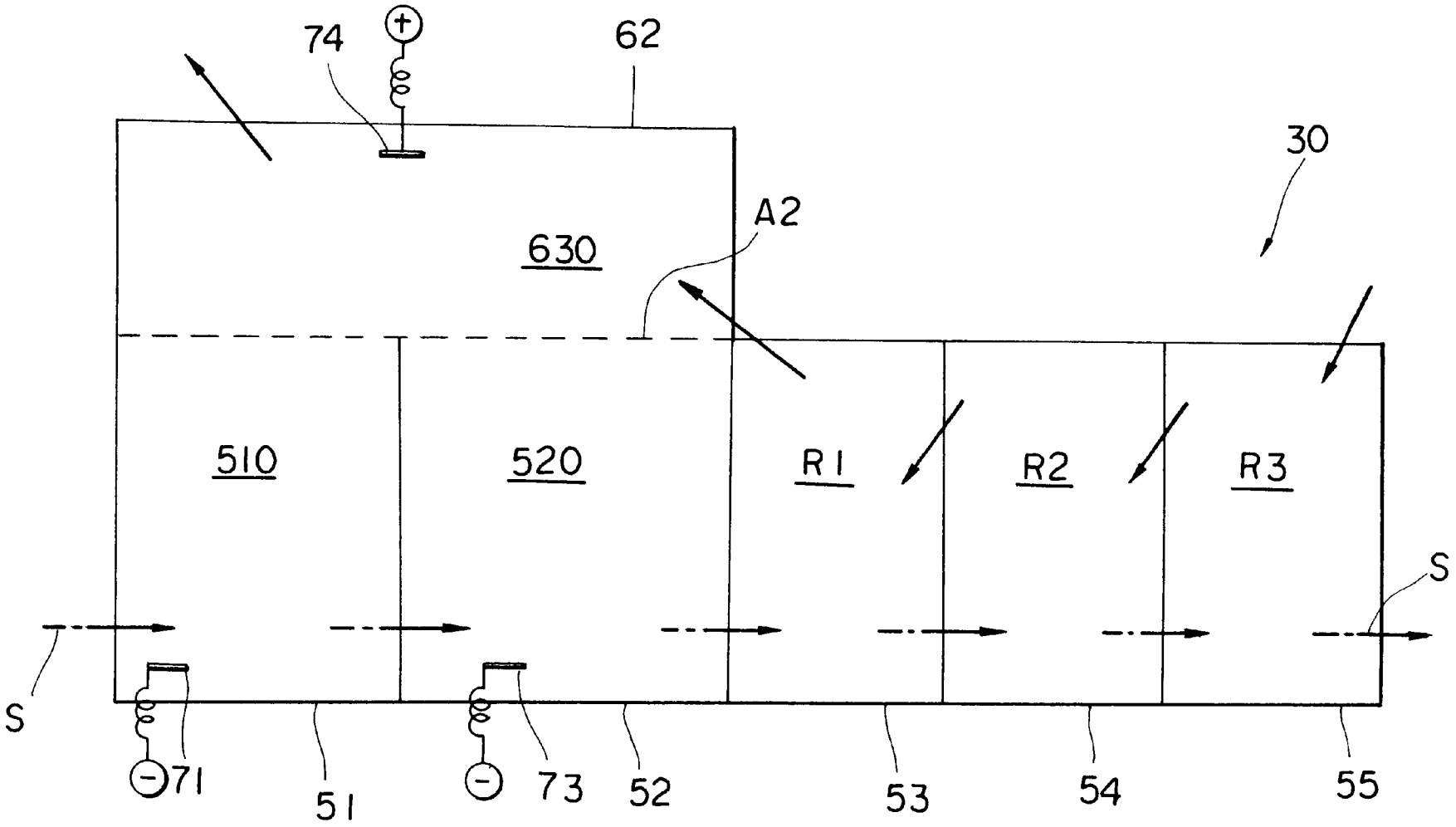
Figure 10:
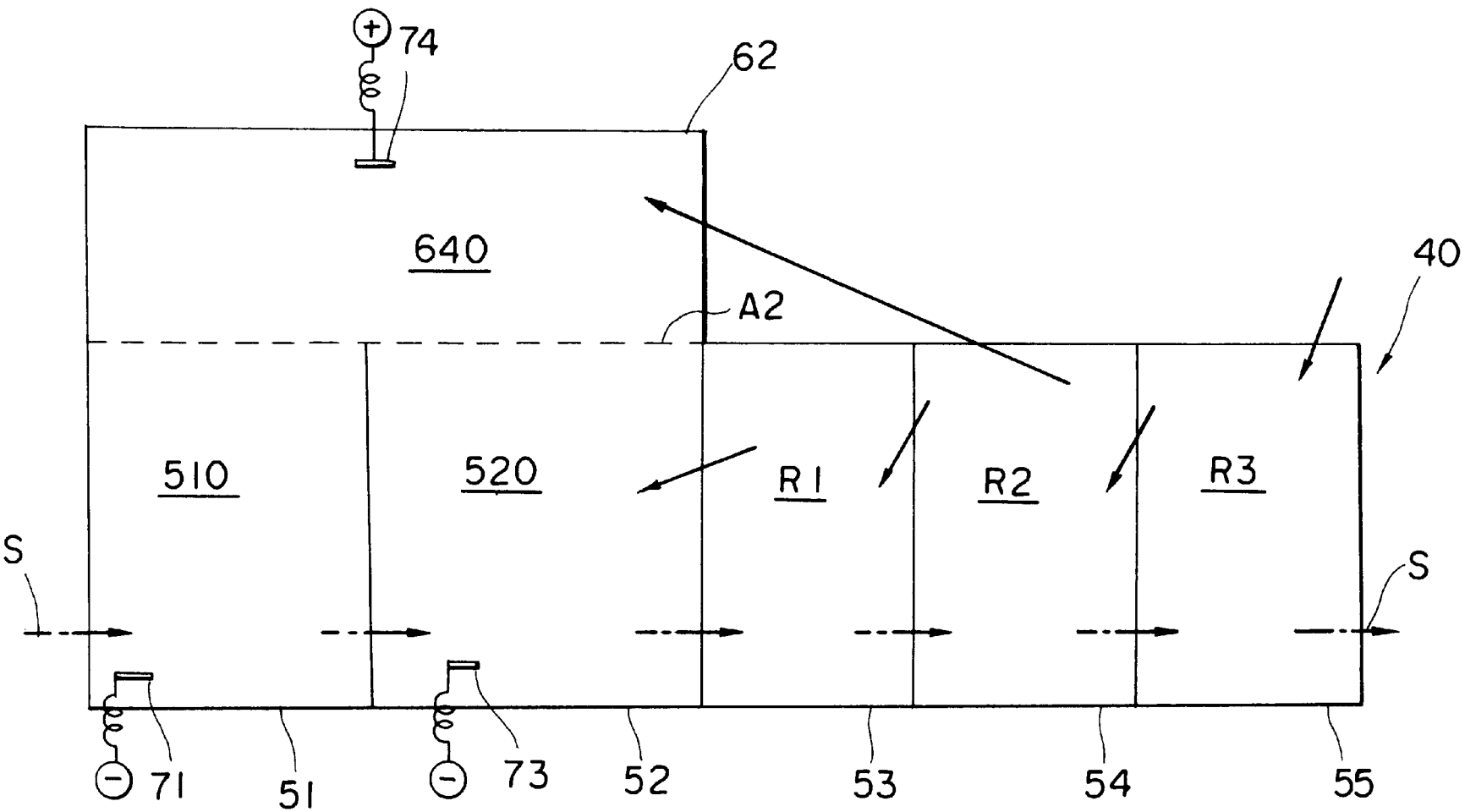

FIG. 10 shows a processing system 40 having the same arrangement as the system of FIG. 9 except that the developing tank 51 is charged with black-and-white developer 510, an electrolyte solution 640 is an overflow from the second rinsing tank 54 entering the solution tank 62, and an overflow from the first rinsing tank 53 enters the fixing tank 52.

With this arrangement, both the developer 510 and fixer 520 restore the developing and fixing powers, respectively, since the preservatives, developing agent and fixing agent which have been air oxidized during quiescent periods are reduced. This, combined with a benefit that halide ions migrate into the electrolyte solution 640, allows the amount of the respective solutions replenished to be diminished. Further, although the black-and-white developer is susceptible to silver sludging due to a relatively high content of sulfite preservative, the deposition of silver on the cathode prevents occurrence of silver sludging. Deposition of silver on the cathode also occurs in the fixer, enabling silver recovery and fixer regeneration. No problem arises with regard to electric conduction even when rinsing liquid R2 of the second rinsing tank 14 is used as the electrolyte solution 640.

Since an overflow of the first rinsing tank 53 enters the fixing tank 52, the fixer components which have been dragged into rinsing liquid R1 by the photosensitive material can now be used again, resulting in diminished replenishment while imposing no problem to photographic performance. This is partly because of electric conduction across the fixer in contact with the electrolyte solution 640 through the anion exchange membrane A2 minimizing a chance of fixation inhibition.

Figure 11:
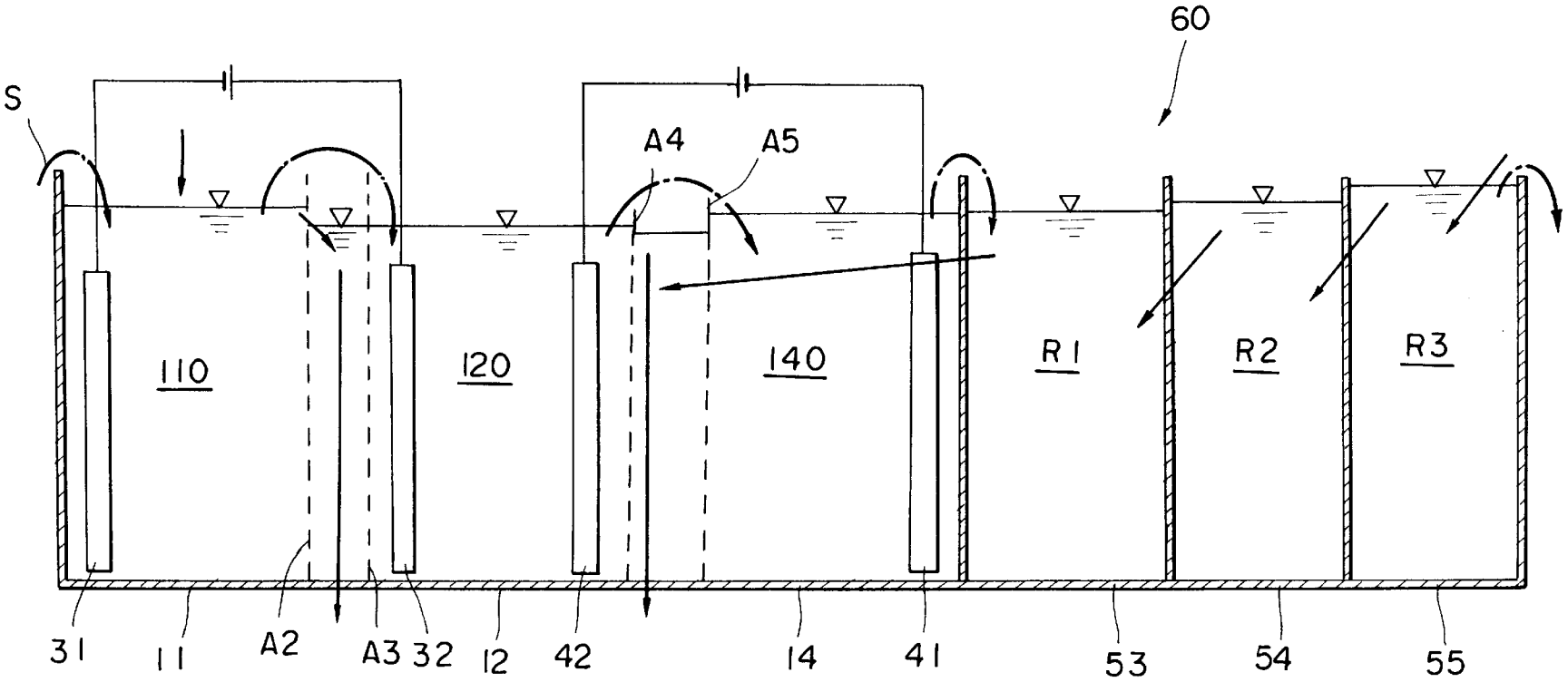
FIG. 11 is a schematic elevational view of the tank arrangement of a yet further processing system according to the present invention.

FIG. 11 shows a system obtained by combining the system of FIG. 2 with the rinsing tanks 53, 54, 55 of FIG. 9 such that an overflow of the developer 110 enters the electrolyte solution between the developing and bleaching tanks 11 and 12 which is discharged in an overflow manner, and an overflow from a rinsing tank enters the electrolyte solution between the bleaching and fixing tanks 12 and 14 which is discharged in an overflow manner.

It will be understood that although an anion exchange membrane is installed in the main tank in the illustrated embodiments, it is possible to install, additionally or instead, an anion exchange membrane in an auxiliary tank connected to the main tank for communication of processing solution so that the membrane intervenes between the processing solution and an electrolyte solution. Although three rinsing tanks are used in the illustrated embodiments, the number of rinsing tanks is not limited thereto and may range from 2 to 20. If desired, a processing tank may be used of the design that a plurality of processing compartments are connected through narrow channels as shown in JP-A 267648/1989.

The above-mentioned method for lowering the COD of a black-and-white developer and fixer to alleviate waste liquid loads is applicable to not only the processing of black-and-white photosensitive materials as mentioned above, but also the processing of color photosensitive materials. While the processing solutions often contain conductive substances and the photosensitive material to be processed is also conductive, the present invention requires to newly install electrode members other than these conductive ones.

Included in the photosensitive material used in the practice of the present invention are a variety of color and black-and-white photosensitive materials, for example, color negative films, color reversal films, photographic color papers, color positive films, color reversal papers, process photographic photosensitive materials, X-ray photographic photosensitive materials, black-and-white negative films, photographic black-and-white papers, microfilm photosensitive materials, and the like. Among these photosensitive materials are those picture taking photographic films such as color negative films and black-and-white negative films having image information carried in the films themselves or their storage containers. The electricity quantity to be conducted may be determined in accordance with the exposure information in such picture taking photographic films.

The present invention maintain the processing ability constant at all times during processing of photosensitive material by conducting electricity. It will be understood that electric conduction can be provided during processing and additionally after processing or either before or after processing.

Next, the processing solutions used in the present invention and processing conditions associated therewith are described. First, the processing of color photosensitive material is described. The color developer used herein is preferably an alkaline aqueous solution containing an aromatic primary amine color developing agent as a main ingredient. Useful color developing agents are aminophenol compounds, but p-phenylenediamine compounds are more useful. Typical examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidethylaniline, and 3-methyl-4-amino-N-ethyl-N-β-methoxyethylaniline, and sulfate, hydrochloride, phosphate, p-toluenesulfonate, tetraphenylborate, and p-(t-octyl)benzylsulfonate salts thereof. Two or more of them may be used for a particular purpose.

Although the color developing agents undergo air oxidation during quiescent periods or the like and as a result, the color developer lowers its developing power, the present invention prevents such developing power lowering and therefore, sensitivity lowering and gradation softening.

The color developer may contain pH buffer agents such as alkali metal carbonates, borates and phosphates; development inhibitors or antifoggants such as bromides, iodides, benzimidazoles, benzothiazoles and mercapto compounds; preservatives such as hydroxylamine, triethanol amine, the compounds described in German OLS 2,622,950, sulfites and bisulfites; organic solvents such as diethylene glycol; development promoters such as benzyl alcohol, polyethylene glycol, quaternary ammonium salts, amines, thiocyanates, 3,6-thiaoctane-1,8-diol; dye-forming couplers; competitive couplers; nucleating agents such as sodium boron hydride; auxiliary developing agents such as 1-phenyl-3-pyrazolidone; thickeners; fluorescent brighteners such as 4,4'-diamino-2,2'-disulfostilbene compounds; and chelating agents such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, triethylenetetraminepentaacetic acid and aminopolycarboxylic acids as represented by the compounds disclosed in JP-A 195845/1983, 1-hydroxyethylidene-1,1'-diphosphonic acid, organic phosphonic acids as disclosed in Research Disclosure, No. 18170 (May 1979), aminophosphonic acids such as aminotris (methylenephosphonic acid) and ethylenediamine-N,N,N',N'-tetramethylenesulfonic acid, and phosphonocarboxylic acids as disclosed in JP-A 102726/1977, 42730/1978, 121127/1979, 4024/1980, 4025/1980, 126241/1980, 65955/1980, and 65956/1980, and Research Disclosure No. 18170 (May 1979).

Among these additives, the present invention is effective in preventing oxidative decomposition of the preservatives and thus preventing a lowering of developing power.

Generally, the color developing agent is used in a concentration of about 0.1 to about 20 grams per liter of the color developer, preferably in a concentration of about 0.5 to about 10 grams per liter of the color developer.

The color developer used herein generally has a pH of at least 7, preferably from about 9 to about 13, more preferably from 9 to 11.

The first black-and-white developer used for reversal processing in the practice of the present invention may contain various additives as used in the black-and-white developer to be described later for processing black-and-white silver halide photosensitive materials.

Description is made to bleaching solution, blix solution and fixing solution (fixer) which can be a solution having bleaching function or a solution having fixing function to be used for desilvering purpose in the practice of the present invention.

The bleaching and blix solutions contain bleaching agents, which may be selected from ferric ion complexes and complexes of ferric ions with chelating agents such as aminopolycarboxylic acids, aminopolyphosphonic acids or salts thereof.

Typical chelating agents in the form of aminopolycarboxylic acids, aminopolyphosphonic acids or salts thereof include ethylenediaminetetraacetic acid, disodium ethylenediaminetetraacetate, diammonium ethylenediaminetetraacetate, tetra(trimethylammonium) ethylenediaminetetraacetate, tetrapotassium ethylenediaminetetraacetate, tetrasodium ethylenediaminetetraacetate, trisodium ethylenediaminetetraacetate, diethylenetriaminepentaacetic acid, pentasodium diethylenetriaminepentaacetate, ethylenediamine-N-(β-oxyethyl)-N,N',N'-triacetic acid, trisodium ethylenediamine-N-(β-oxyethyl)-N,N',N'-triacetate, triammonium ethylenediamine-N-(β-oxyethyl)-N,N',N'-triacetate, 1,2-diaminopropanetetraacetic acid, disodium 1,2-diaminopropanetetraacetate, 1,3-diaminopropanetetraacetic acid, diammonium 1,3-diaminopropanetetraacetate, nitrilotriacetic acid, trisodium nitrilotriacetate, cyclohexanediaminetetraacetic acid, disodium cyclohexanediaminetetraacetate, iminodiacetic acid, dihydroxyethylglycine, ethyl ether diamine tetraacetic acid, glycol ether diamine tetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, etc. although the chelating agents are not limited to these compounds.

The iron ion complex salts may be either used in the form of complex salt or formed in solution using ferric salts such as ferric sulfate, ferric chloride, ferric nitrate, ferric sulfate ammonium, and ferric phosphate and chelating agents such as aminopolycarboxylic acids and phosphonocarboxylic acids. For use in complex salt form, a single complex salt or a mixture of two or more complex salts may be used. Where a ferric ion complex salt is formed in solution using a ferric salt and a chelating agent, a single ferric salt or a mixture of two or more ferric salts may be used. In either case, the chelating agent may be used in excess of the necessary amount to form a ferric ion complex salt. Preferred among the iron complexes are iron aminopolycaboxylate complexes which are added in amounts of 0.1 to 1 mol/liter, preferably 0.2 to 0.4 mol/liter of a bleaching solution and 0.05 to 0.5 mol/liter, preferably 0.1 to 0.3 mol/liter of a blix solution for picture-taking color photosensitive materials such as color negative film. The complexes are added in amounts of 0.03 to 0.3 mol/liter, preferably 0.05 to 0.2 mol/liter of a bleaching or blix solution for printing color photosensitive materials such as color paper.

As opposed to the fact that as photosensitive material is processed, the processing solution as a solution having bleaching function lowers its oxidizing power because the iron (III) complex is reduced to an iron (II) complex, the present invention allows the solution to restore its oxidizing power. Therefore, the occurrence of deficient desilvering and deficient color recovery is prevented.

If desired, the bleaching and blix solutions may contain bleaching promoters. Among others, compounds having mercapto or disulfide groups are preferred because of great promotion, with the compounds described in U.S. Pat. No. 3,893,858, German Patent No. 1,290,812, and JP-A 95630/1978 being most preferred.

Additionally, the bleaching or blix solution used herein may contain re-halogenating agents such as bromides (e.g., potassium bromide, sodium bromide, ammonium bromide), chlorides (e.g., potassium chloride, sodium chloride, ammonium chloride) and iodides (e.g., ammonium iodide). If necessary, there may be added one or more inorganic and organic acids having pH buffering function and alkali metal and ammonium salts thereof such as boric acid, borax, sodium metaborate, acetic acid, sodium acetate, sodium carbonate, potassium carbonate, phosphonic acid, phosphoric acid, sodium phosphate, citric acid, sodium citrate, and tartaric acid and corrosion-preventing agents such as ammonium nitrate and guanidine.

The blix and fixing solutions used herein contain fixing agents which may be well-known fixing agents, that is, water-soluble silver halide-dissolving agents including throsulfates such as sodium thiosulfate and ammonium thiosulfate thiocyanates; thioethers such as ethylene bisthioglycolic acid and 3,6-dithia-1,8-octanediol; and thioureas, alone or in admixture of two or more. Also useful are special blix solutions comprising, in combination, fixing agents described in JP-A 155354/1976 and a large proportion of halides such as potassium iodide.

Preferred in the practice of the present invention are thiosulfates, especially ammonium thiosulfate. The amount of the fixing agent per liter preferably ranges from 0.3 to 2 mol, especially from 0.8 to 1.5 mol for the processing of picture-taking color photosensitive material and 0.5 to 1 mol for the processing of printing color photosensitive material.

Although the fixing agents undergo air oxidation during quiescent periods or the like and as a result, the processing solution as a solution having fixing function lowers its fixing power, the present invention prevents such fixing power lowering. Therefore, the occurrence of deficient desilvering and sulfide formation are prevented.

The bleaching, blix and fixing solutions used herein are preferably in a pH range of from 3 to 10, more preferably from 5 to 9. Lower pH below this range increases desilvering ability, but promotes solution fatigue and conversion of cyan dyes into leuco form. Inversely, higher pH above this range delays desilvering and tends to incur staining. For pH adjustment, hydrochloric acid, sulfuric acid, nitric acid, acetic acid, bicarbonates, ammonia, caustic potash, caustic soda, sodium carbonate, potassium carbonate, etc. may be added if needed.

The blix solution may further contain various fluorescent brighteners, defoaming agents, surfactants, polyvinyl pyrrolidone, and organic solvents such as methanol.

The blix and fixing solutions used herein may contain sulfite ion releasing compounds as preservatives, for example, sulfites (e.g., sodium sulfite, potassium sulfite, ammonium sulfite, etc.), bisulfites (e.g., sodium bisulfite, potassium bisulfite, ammonium bisulfite, etc.), and metabisulfites (e.g., sodium metabisulfite, potassium metabisulfite, ammonium metabisulfite, etc.). These compounds are preferably contained in an amount of about 0.02 to 0.50 mol/liter, more preferably 0.04 to 0.40 mol/liter, calculated as sulfite ion. Although sulfites are generally added as the preservatives, it is acceptable to add ascorbic acid, carbonyl bisulfite adducts, carbonyl compounds or the like instead.

The present invention prevents oxidative decomposition of these preservatives in processing solutions as the solution having fixing function, thus preventing occurrence of deficient desilvering and sulfide formation. Additionally, buffer agents, fluorescent brighteners, chelating agents, antifungal agents may be added to the blix and fixing solutions, if necessary.

The blix solution used herein may also be a solution prepared by mixing bleaching and fixing solutions.

In the practice of the present invention, desilvering is followed by water washing and/or stabilization. The washing step may use deionized water as well as city water. Also useful is water having added thereto water softeners, bactericidal or antifungal agents, surfactants, and the like.

The amount of washing water used may vary over a wide range depending on the characteristics of photosensitive material (for example, couplers and other components contained therein), water temperature, and other factors. Washing water is at pH 4 to 9, preferably pH 5 to 8.

To the stabilizer used in the stabilization step are added compounds having image stabilizing function. Examples include aldehyde compounds as typified by formalin, buffer agents for adjusting optimum film pH for dye stabilization, and ammonium compounds. Further, there may be added various bactericidal agents, antifungal agents, surfactants, brighteners, hardeners, chelating agents, and magnesium and bismuth compounds.

For the detail of color photosensitive material processing, reference is made to JP-A 70857/1988, 190889/1989, 198754/1989, and 106050/1989.

Next, the processing of black-and-white photosensitive material is described.

In the practice of the present invention, the black-and-white developer contains developing agents primarily comprising hydroquinones such as hydroquinone, but preferably hydroquinones combined with 1-phenyl-3-pyrazolidones and hydroquinones combined with p-aminophenols because of improved performance.

The hydroquinone developing agents are generally used in an amount of 0.01 to 1.5 mol/liter, preferably 0.05 to 1.2 mol/liter.

In addition, the p-aminophenol developing agents are generally used in an amount of 0.0005 to 0.2 mol/liter, preferably 0.001 to 0.1 mol/liter.

The black-and-white developer used herein contains preservatives in the form of sulfites, for example, sodium sulfite, potassium sulfite, lithium sulfite, ammonium sulfite, sodium bisulfite, and potassium metabisulfite. The sulfites are used in an amount of at least 0.2 mol/liter, preferably at least 0.4 mol/liter. The upper limit is preferably up to 2.5 mol/liter.

The black-and-white developer used herein are preferably in a pH range of from 8.5 to 13, more preferably from 9 to 12.

Although the developing agents and preservatives undergo air oxidation and consequently, oxidative decomposition during quiescent periods or the like and as a result, the developer lowers its developing power, the present invention prevents such developing power lowering. Therefore, sensitivity lowering is prevented.

Further, metal compounds may also be used as the developing agent. The metals of the metal compounds include transition metals capable of assuming some different oxidation states such as Ti, V, Cr, and Fe. Therefore, when used as the developing agent, theoretically metal compounds having a lower oxidation state than the highest oxidation state are used to utilize the available reducing power. Usually, $Ti^{3+}$, $V^{2+}$, $Cr^{2+}$, and $Fe^{2+}$ are used for Ti, V, Cr, and Fe, respectively. Preferred among others are $Ti^{3+}$ and $Fe^{2+}$. These metal compounds may be complexes as well as commonly used salts. The salts include halides such as chlorides, bromides, and iodides, oxalates, sulfates, acetates, citrates, for example, $TiCl_3$, $TiBr_3$, $TiI_3$, $FeCl_2$, $FeBr_2$, $VCl_2$, $V(SO_4)$, $Fe(COO)_2$, $Fe_4$, $Fe(CH_3COO)_2$, iron (II) citrate, etc. The complexes contain $Ti^{3+}$ and $Fe^{2+}$ as the center metal with preferred ligands being multidentate ligands. Examples of the ligand include aminopolycarboxylic acids such as ethylenediaminetetraacetic acid (EDTA), diethylenetriaminepentaacetic acid (DTPA) and salts thereof, aminopolyphosphoric acids such as ethylenediamine-N,N,N',N'-tetramethylene phosphoric acid and 1,3-diaminopropanol-N,N,N',N'-tetramethylene phosphoric acid and salts thereof, carboxylic acids such as nitrilotriacetic acid, oxalic acid, and citric acid and salts thereof, and phosphoric acids such as nitrilo-N,N,N-trimethylene phosphoric acid and propylamino-N,N-dimethylene phosphoric acid and salts thereof. Preferred among others are complexes having EDTA, DTPA and similar ligands. These complexes can be formed in the developer by adding metal salts and ligand compounds, and such a method is also preferred in the present invention.

For the detail of these metal compounds, reference is made to JP-B 41899/1979 and the publications cited therein. The metal compounds may be contained in the developer in amounts of 1 to 100 gram/liter, preferably 5 to 50 gram/liter. The developer may further contain pH buffer agents, antifoggants, and various other additives, which are described in JP-B 41899/1979. The developer is at pH 0.5 to 11, preferably pH 1 to 11, more preferably pH 2.5 to 9.

The developers containing developing agents in the form of metal compounds have the advantages of high developing agent concentration and low pH level usage and the disadvantage that it is difficult to maintain developing activity constant due to a change of metal's oxidation state. The present invention overcome this disadvantage.

In the practice of the present invention, the development mentioned above is followed by a fixation step which uses a fixer or an aqueous solution containing a fixing agent at pH 3.8 or higher, preferably pH 4.2 to 7.0.

The fixing agents include sodium thiosulfate and ammonium thiosulfate, with the ammonium thiosulfate being preferred for fixation rate. The amount of fixing agent used may be properly chosen, generally in the range of from about 0.1 to about 3 mol/liter.

The fixer may contain water-soluble aluminum salts acting as the hardener, for example, aluminum chloride, aluminum sulfate, and potassium alum.

To the fixer may be added tartaric acid, citric acid, gluconic acid and derivatives thereof alone or in admixture of two or more. These compounds are contained in amounts of at least 0.005 mol per liter of the fixer, preferably 0.01 to 0.03 mol/liter.

If desired, the fixer may contain preservatives (e.g., sulfites and bisulfites), pH buffer agents (e.g., acetic acid and boric acid), pH adjusting agents (e.g., sulfuric acid), chelating agents capable of softening hard water, and the compounds described in JP-A 78551/1987.

Although the fixing agents and preservatives undergo air oxidation and consequently, oxidative decomposition during quiescent periods or the like, the present invention prevents such oxidation. Therefore, the occurrence of deficient fixation and sulfide formation are avoided.

The fixation step is followed by a water washing and/or stabilization step as in the processing of color photosensitive material. The washing water or stabilizing solution for processing can be replenished in amounts of up to 3 liters per square meter of silver halide photosensitive material (inclusive of 0, that is, batchwise tank water washing).

For such water saving or piping-free processing, the washing water or stabilizing solution is preferably provided with antifungal means.

Suitable antifungal means include UV exposure as disclosed in JP-A 263939/1985, magnetic field application as disclosed in JP-A 263940/1985, water passage through an ion-exchange resin for purification as disclosed in JP-A 131632/1986, ozone blowing, and the use of antifungal agents as disclosed in JP-A 115154/1987, 153952/1987, and 91533/1989 and Japanese Patent Application Nos. 63030/1986 and 51396/1986.

In addition, microbiocides, fungicides, and surfactants as disclosed in L. F. West, "Water Quality Criteria," Photo. Sci. & Eng., Vol. 9, No. 6 (1965), M. W. Beach, "Microbiological Growth in Motion-Picture Processing," SMPTE Journal, Vol. 85, March 1976, R. O. Deegan, "Photoprocessing Wash Water Biocides," J. Imaging Tech., Vol. 10, No. 6 (1984), JP-A 8542/1982, 58143/1982, 97530/1982, 132146/1982, 157244/1982, 18631/1983, and 105145/1983, may be used in a suitable combination.

The washing or stabilizing bath may additionally contain a microbiocide selected from the isothiazolines disclosed in R. T. Kreiman, J. Imaging Tech., 10, 6, page 242 (1984), the isothiazolines disclosed in Research Disclosure, Vol. 205, No. 20526, May 1981, the isothiazolines disclosed in Research Disclosure, Vol. 228, No. 22845, April 1983, and the compounds disclosed in JP-A 209532/1987.

Besides, the bath may contain any of the compounds disclosed in Horiguchi, Hiroshi, "Chemistry of Biocides and Fungicides," Sankyo Publishing K.K., 1982 and Japan Biocide and Fungicide Associate, "Handbook of Biocidal and Fungicidal Technology," Hakuhodo K.K., 1986.

For the detail of black-and-white photosensitive material processing, reference may be made to JP-A 93737/1989, 250947/1989, 103035/1990, 103037/1990, 71260/1990, and 267559/1986.

For the detail of color and black-and-white photosensitive materials which can be processed by the present invention, reference may be made to JP-A 259359/1989 and the above-cited patent publications.

EXAMPLE

Examples of the present invention are given below by way of illustration.

Example 1

Strips of color negative film identified as sample B in Example 2 of U.S. Pat. No. 4,962,474 were exposed to light and subjected to two rounds of running operation with a color developer according to the following procedure, using an automatic motion picture film processing machine. Thereafter, running operation (known as occasional processing) at a rate of one 135-size 24-frame film per day was continued for 4 months while the temperature controlling time was 10 hours per day.

| Procedure | | | | |
|---|---|---|---|---|
| | Processing | | Replenish- | Tank |
| Step | Time | temp. | ment | volume |
| Color development | 3'15" | 38° C. | 45 ml | 10 liters |
| Bleaching | 1'00" | 38° C. | 20 ml | 4 liters |

-continued

| Procedure | | | | |
|---|---|---|---|---|
| | Processing | | Replenish- | Tank |
| Step | Time | temp. | ment | volume |
| (Bleaching)* | 3'15" | 38° C. | 30 ml | 8 liters |
| Washing (1) | 40" | 35° C. | counterflow from (2) to (1) | 4 liters |
| Washing (2) | 1'00" | 35° C. | 30 ml | 4 liters |
| Stabilization | 40" | 38° C. | 20 ml | 4 liters |
| Drying | 1'15" | 55° C. | | |

Replenishment amount is per l m length of a 35-mm wide film
*An overflow of the bleaching solution is channeled to the fixer tank.

The processing solutions had the following compositions.

| | | Tank (g) | Replenisher (g) |
|---|---|---|---|
| Color developer | | | |
| Diethylenetriaminepentaacetic acid | | 1.0 | 1.1 |
| 1-hydroxyethylidene-1,1-diphosphonic acid | | 3.0 | 3.2 |
| Sodium sulfite | | 4.0 | 4.9 |
| Potassium carbonate | | 30.0 | 30.0 |
| Potassium bromide | | 1.4 | — |
| Potassium iodide | | 1.5 mg | — |
| Hydroxylamine hydrogensulfate | | 2.4 | 3.6 |
| 4-(N-ethyl-N-β-hydroxyethylamino)-2-methylaniline hydrogensulfate | | 4.5 | 7.2 |
| Water | totaling to | 1.0 l | 1.0 l |
| | pH | 10.05 | 10.10 |
| Bleaching solution | | | |
| Ferric 1,3-diaminopropanetetraacetate ammonium monohydrate | | 144.0 | 206.0 |
| 1,3-diaminopropanetetraacetic acid | | 2.8 | 4.0 |
| Ammonium bromide | | 84.0 | 120.0 |
| Ammonium nitrate | | 30 | 30 |
| Aqueous ammonia (27%) | | 10.0 | 1.8 |
| Acetic acid (98%) | | 51.1 | 73.0 |
| Water | totaling to | 1.0 l | 1.0 l |
| | pH | 4.3 | 3.4 |

| | | Tank/Replenisher (g) |
|---|---|---|
| Fixer | | |
| Disodium ethylenediaminetetraacetate | | 1.7 |
| Sodium sulfite | | 14.0 |
| Sodium bisulfite | | 10.0 |
| Ammonium thiosulfate aqueous solution (70 wt/vol %) | | 320.0 |
| Water | totaling to | 1.0l |
| | pH | 7.2 |

Washing liquid (common to tank and replenisher)

City water was passed through a mixed bed column loaded with an H type strong acid cation-exchange resin (Amberlite IR-120B by Rohm & Haas Co.) and an OH type anion-exchange resin (Amberlite IR-400) to reduce the calcium and magnesium ion concentrations to less than 3 mg/l. To the deionized water were added 20 mg/l of sodium isocyanurate dichloride and 1.5 g/l of sodium sulfate. This liquid was at pH 6.5 to 7.5.

| Stabilizer | | Tank/replenisher | |
|---|---|---|---|
| Surfactant | | 0.5 | g |

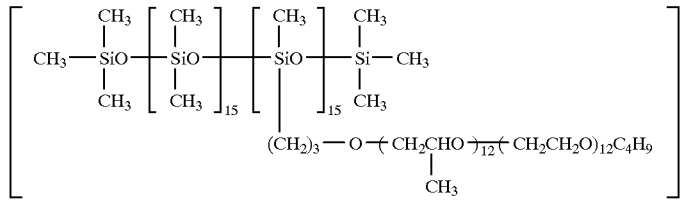

| | | | |
|---|---|---|---|
| Surfactant $C_{10}H_{21}—O—(CH_2CH_2O)_{10}—H$ | | 0.4 | g |
| Triethanolamine | | 2.0 | g |
| 1,2-benzisothiazolin-3-one | | 0.01 | g |
| Methanol | | 0.3 | g |
| Formalin (37%) | | 1.5 | g |
| Water | totaling to | 1 | liter |
| | pH | 6.5 | |

This procedure is designated Procedure 1A.

Procedure 1A was repeated except that the color developing and bleaching tanks of the processor were replaced by those having electrodes installed therein as shown in FIG. 1. This procedure is designated Procedure 1B.

The cathode installed in the color developing tank was a molybdenum-containing stainless steel (corresponding to SUS 316) sheet (NTK 316 manufactured by Nihon Metal Industry K.K., size 15 cm×100 cm×1 mm thick) and the anode installed in the bleaching tank was a carbon sheet (Kure Sheet manufactured by Kureha Chemical Industry K.K., size 15 cm×100 cm×1 mm thick). The anion exchange membrane used was Neosepta AM-3 (manufactured by Tokuyama Soda K.K.).

Electric conduction was by applying a voltage of 2.5 V to pass a current flow of 0.8 A (current density 0.3 mA/cm$^2$). The voltage was applied after 1 minute upon receipt of a signal indicative of the processing of photosensitive material and electric conduction was interrupted when no signal indicative of photosensitive material processing was received for 20 minutes.

For both Procedures 1A and 1B, the photographic performance at the end of two rounds and the photographic performance at the end of 4-month operation were evaluated. The photographic performance was evaluated by examining the sensitivity and gradation of a green-sensitive layer, desilvering deficiency, and color recovery deficiency. The percent losses of sensitivity and gradation at the end of 4-month operation were also determined. The sensitivity is expressed in relative sensitivity based on 100 at the end of two rounds and evaluated by determining an inverse of the exposure necessary to provide a predetermined density. The gradation was evaluated by determining an average gradient of a characteristic curve (D-logE curve). The deficient desilvering was evaluated by silver analysis using fluorescent X-ray.

The deficient color recovery was evaluated by determining the density of sensitometry exposed, processed photosensitive material using red light, processing the material from the bleaching solution again, and determining the density again, thereby determining an increase in density by re-processing at a red transmission density of 1.2. The color recovery was evaluated deficient when a density increase of 0.1 or more was detected. Further, the content of sodium sulfite (preservative) in the color developer at the end of 4-month running operation was determined, determining a percent loss (percent SS loss) at the end of 4-month operation relative to the end of two rounds. The preservative content was determined by iodometry.

The results are shown in Table 1.

TABLE 1

| | Sensitivity | | | Gradation | | |
|---|---|---|---|---|---|---|
| Procedure | 2 round | 4 month | Loss | 2 round | 4 month | Loss |
| 1A (comparison) | 100 | 81 | 19% | 0.63 | 0.46 | 27% |
| 1B (invention) | 100 | 97 | 3% | 0.63 | 0.61 | 3% |

| | Deficient desilvering | | Deficient color recovery | | SS loss (color |
|---|---|---|---|---|---|
| Procedure | 2 round | 4 month | 2 round | 4 month | developer) |
| 1A | no | occurred | no | occurred | 86% |
| 1B | no | no | no | no | 40% |

As seen from Table 1, sensitivity lowering and gradation softening occurred in conventional Procedure 1A as a result of occasional processing. In contrast, sensitivity and gradation changed little in Procedure 1B according to the present invention. Since halide ions such as $Br^-$ migrated into the bleaching solution, Procedure 1B allowed the amount of ammonium bromide added to the replenisher to be diminished to 60 gram/liter.

Example 2

In Procedure 1B of Example 1, two anion exchange membranes were placed between the color developer and the bleaching solution and 1% sodium chloride water was interposed therebetween.

There were obtained equivalent results to the results of Procedure 1B of Example 1. The interposition of the electrolyte solution improved the durability of the anion exchange membrane (about three times). Thus, the frequency of membrane replacement was decreased. Alternatively, anion exchange membranes of lower quality became acceptable.

Example 3

Procedure 1A of Example 1 was repeated except that after the two rounds of running operation, running operation at a rate of 300 films per day was continued for two weeks while the temperature controlling time was 10 hours per day. This is designated Procedure 3A.

Also, Procedure 3A was repeated except that the color developing and bleaching tanks of the processor were replaced by those having electrodes installed therein as shown in FIG. 1. The electrodes and anion exchange membrane used were, in principle, the same as those used in Procedure 1B of Example 1. This procedure is designated Procedure 3B.

Further, Procedure 3A was repeated except that the bleaching and fixing tanks of the processor were replaced by those having an anion exchange membrane intervening between the bleaching and fixing solutions and an anode immersed in the bleaching solution and a cathode immersed in the fixer. This procedure is designated Procedure 3*C*. The electrodes and anion exchange membrane used were the same as above.

Further, Procedure 3A was repeated except that the color developing, bleaching and fixing tanks of the processor were replaced by the arrangement of FIG. 2, but anion exchange membranes intervening between the color developing and bleaching solutions and between the bleaching and fixing solutions without interposing electrolyte solution. This procedure is designated Procedure 3D. The electrodes and anion exchange membrane used were the same as above.

The electrode dimensions and electricity conducting conditions are given below.

(1) Between color developing and bleaching tanks (a) Cathode dimensions: 15 cm×60 cm Anode dimensions: 15 cm×60 cm (b) Electric conduction Applied voltage: 2.5 V Current flow: 0.8 A (current density 2 mA/cm$^2$)

(2) Between bleaching and fixing tanks (a) Anode dimensions: 15 cm×60 cm Cathode dimensions: 15 cm×60 cm (b) Electric conduction Applied voltage: 2.5 V Current flow: 0.8 A (current density 2 mA/cm$^2$)

For Procedures 3A, 3B, 3*C*, and 3D, the photographic performance at the end of two rounds and the photographic performance at the end of 2-week operation were evaluated.

The photographic performance was evaluated as in Example 1 by examining the sensitivity and gradation of a green-sensitive layer, deficient desilvering, and deficient color recovery. It is to be noted that the desilvering deficiency was also examined by observing a developed dye portion by means of a far-infrared inspector. The results are shown in Table 2.

In Procedures 3A, 3B, 3*C*, and 3D, after the 2-week operation, running operation at a rate of one film per day was continued for a further 4 months. The sensitivity and gradation of a green-sensitive layer were examined at the end of 4-month operation. Separately in these Procedures, the fixers after the 2-week operation were allowed to stand for 4 months without any processing, observing the occurrence of precipitates. The results are also shown in Table 2.

TABLE 2

| | Sensitivity | | | Gradation | | |
|---|---|---|---|---|---|---|
| Procedure | 2 round | 2 week | 4 month | 2 round | 2 week | 4 month |
| 3A (comparison) | 100 | 96 | 63 | 0.63 | 0.61 | 0.41 |
| 3B (invention) | 100 | 100 | 96 | 0.63 | 0.63 | 0.61 |
| 3C (invention) | 100 | 100 | 95 | 0.63 | 0.63 | 0.60 |
| 3D (invention) | 100 | 100 | 95 | 0.63 | 0.63 | 0.61 |

| Procedure | Deficient desilvering | | Deficient color recovery | | Precipitate in fixer |
|---|---|---|---|---|---|
| | 2 round | 2 week | 2 round | 2 week | (4 month standing) |
| 3A | no | occurred | no | occurred | occurred |
| 3B | no | no | no | no | no |
| 3C | no | no | no | no | no |
| 3D | no | no | no | no | no |

It is evident from Table 2 that conventional Procedure 3A resulted in unsatisfactory photographic performance, but Procedures 3B, 3*C* and 3D according to the present invention resulted in satisfactory photographic performance. As compared with Procedure 3B, Procedure 3*C* achieved further improvements in desilvering deficiency and color recovery deficiency.

Procedure 3A was repeated, but using an arrangement for aerating the bleaching tank. Both desilvering deficiency and color recovery deficiency were improved, but yet slight deficiencies were found. Further, aeration caused the bleaching solution to splash, undesirably contaminating the processor and the surroundings and entering the color developer.

Since halide ions such as $Br^-$ migrated into the bleaching solution, Procedure 3B allowed the amount of ammonium bromide added to the bleaching replenisher to be reduced to 60 gram/liter. Since similar migration occurred from the fixer, Procedure 3*C* allowed the amount of ammonium bromide added to the bleaching replenisher to be reduced to 90 gram/liter. Since similar migration occurred from both the color developer and fixer, Procedure 3D allowed the amount of ammonium bromide added to the bleaching replenisher to be reduced to 20 gram/liter.

Example 4

Procedure 3D of Example 3 was repeated except that the color developing, bleaching and fixing tanks were replaced by those shown in FIG. 2. That is, in Procedure 3D, two anion exchange membranes were interposed between each pair of processing solutions and 2% potassium bromide water was admitted therebetween.

There were obtained equivalent results to the results of Procedure 3D of Example 3. The interposition of the electrolyte solution between the processing solutions gave the same results as in Example 2.

Example 5

Preparation of plate-shaped silver iodobromide grains With stirring, an aqueous silver nitrate solution (5 grams of silver nitrate) and another aqueous solution containing 0.15 grams of potassium bromide were added to a container containing 30 grams of gelatin and 6 grams of potassium bromide in 1 liter of water at 60° C. over one minute by a double jet mixing method. Further, an aqueous silver nitrate solution (145 grams of silver nitrate) and another aqueous solution containing 4.2 grams of potassium bromide were added thereto by a double jet mixing method. The addition rate was gradually accelerated such that the flow rate at the end of addition was 5 times the flow rate at the start of addition. At the end of addition, the soluble salts were removed at 35° C. by sedimentation, the temperature was raised to 40° C., 75 grams of gelatin was added, and pH was adjusted to 6.7. There was obtained an emulsion containing plate-shaped grains having a projected area diameter of 0.98 μm and an average thickness of 0.138 μm and having a silver iodide content of 3 mol %. The emulsion was subjected to chemical sensitization using gold and sulfur sensitizers combined.

The surface protective layer used was an aqueous gelatin solution containing gelatin, polyacrylamide having an average molecular weight of 8,000, polymethyl methacrylate fine particles (mean particle size 3.0 μm), polyethylene oxide, and hardener. To the emulsion were added a sensitizing dye and potassium iodide in the following proportion.

| | |
|---|---|
| Sensitizing dye anhydrous 5,5'-dichloro-9-ethyl-3,3'-di(3-sulfopropyl)oxacarbocyanine hydroxide sodium salt | 500 mg/mol of Ag |
| Potassium iodide | 200 mg/mol of Ag |

A coating composition was obtained by further adding 4-hydroxy-6-methyl-1,3,3a,7-tetraazaindene, 2,6-bis (hydroxyamino)-4-diethylamino-1,3,5-triazine and nitron as stabilizing agents, trimethylol propane as a drying fogging preventing agent, a coating aid, and a hardener. A photosensitive material was prepared by coating a polyethylene terephthalate support on either surface with the coating composition and the surface protective layer at the same time, followed by drying. Silver coverage (on each surface) 2.0 g/m$^2$.

Processing was carried out as follows. Developer formulation for 38-liter volume

| | | | |
|---|---|---|---|
| Part A | | | |
| Potassium hydroxide | | 1107 | g |
| Potassium sulfite | | 1680 | g |
| Sodium hydrogen carbonate | | 285 | g |
| Boric acid | | 38 | g |
| Diethylene glycol | | 456 | g |
| Ethylenediamine tetraacetic acid | | 63.5 | g |
| 5-methylbenzotriazole | | 2.28 | g |
| Hydroquinone | | 1140 | g |
| Water | totaling to | 9.50 | liters |
| Part B | | | |
| Glacial acetic acid | | 416 | g |
| Diethylene glycol | | 644.5 | g |
| 5-nitroindazole | | 9.5 | g |
| 1-phenyl-3-pyrazolidone | | 57 | g |
| Part C | | | |
| Glutaraldehyde | | 187.3 | g |
| Sodium metabisulfite | | 478.8 | g |
| Water | totaling to | 950 | ml |
| Starter | | | |
| Acetic acid | | 270 | g |
| Potassium bromide | | 300 | g |
| Water | totaling to | 1.5 | liters |

Preparation of developer

A developer replenisher (pH 10.30) was prepared by charging a replenisher stock tank of about 50-liter volume with 20 liters of water, sequentially adding Parts A, B and C to the water and dissolving therein with stirring, and finally making up water to a volume of 38 liters.

The developing tank of the automatic processor was initially charged with a developer (pH 10.15) prepared by adding 20 ml of the starter to 1 liter of the developer replenisher. Thereafter, as the photosensitive material was processed, the developer replenisher was replenished at a rate of 45 ml/quarter-size sheet (10 inches×12 inches).

Fixer formulation for 38 liter volume

| | |
|---|---|
| Part A | |
| Ammonium thiosulfate (70 wt/vol %) | 7.6 g |
| Disodium ethylenediaminetetraacetate dihydrate | 0.76 g |
| Sodium sulfite | 570 g |
| Boric acid | 380 g |
| Sodium hydroxide | 254.6 g |
| Acetic acid | 570 g |
| Water | totaling to 9.5 liters |
| Part B | |
| Aluminum sulfate | 380 g |
| Sulfuric acid (36N) | 148.2 g |
| Water | totaling to 1.9 liters |

Preparation of fixer

A fixer replenisher was prepared by charging a replenisher stock tank of about 50-liter volume with 20 liters of water, sequentially adding Parts A, and B to the water and dissolving therein with stirring, and finally making up water to a volume of 38 liters.

The fixing tank of the automatic processor was initially charged with the same solution as the fixer replenisher (pH 4.25).

Thereafter, as the photosensitive material was processed, the fixer replenisher was replenished at a rate of 30 ml/quarter-size sheet (10 inches×12 inches).

Wash water

City water was used.

The washing tank of the automatic processor was initially charged with wash water.

Replenishment was at a rate of 45 ml/quarter-size sheet (10 inches×12 inches).

| | Processing tank volume | Processing temp. × time |
|---|---|---|
| Development | 11.5 liters | 35° C. × 25 |
| Fixation | 11.5 liters | 35° C. × 20 sec. |
| Washing | 11.5 liters | 20° C. × 15 sec. |
| Drying | | 50° C. |

The dry-to-dry processing time was 96 seconds.

In this way, running operation was continued for two months at a rate of two quarter-size sheets of photosensitive material per day.

This is designated Procedure 5A.

Procedure 5A was repeated except that the processor was replaced by that shown in FIG. 3 having an anion exchange membrane interposed between the developing and fixing solutions and an electrolyte solution and electrodes immersed therein. This procedure is designated Procedure 5B.

The tank arrangement was modified so as to meet the processing procedure, and the electrodes and anion exchange membrane used were the same as used in Example 1. The electrolyte solution used was a 2% solution of $K_2SO_4$.

Electric conduction was by applying a voltage of 3 V to pass a current flow of 1.1 A (current density 0.4 mA/cm$^2$). The voltage was applied after 1 minute upon receipt of a signal indicative of the processing of photosensitive material and electric conduction was interrupted when no signal indicative of photosensitive material processing was received for 20 minutes.

For both Procedures 5A and 5B, sensitivity and gradation were examined at the start and the end of 2-month running operation. The running operation was continued for a further 5 months, after which deficient fixation was examined.

The gradation was a gradient of a linear section of a photographic characteristic curve, and fixation degree was examined by determining a silver amount by fluorescent X-ray spectroscopy, with a silver amount in excess of 5 $\mu$g/cm$^2$ judged to be deficient fixation.

Further, the loss of sulfite (preservative) in the black-and-white developer and fixer was determined as in Example 1. Separately, the fixer after the 1-week running operation was allowed to stand for 5 months, observing the occurrence of precipitates.

The results are shown in Table 3.

TABLE 3

| | Sensitivity | | Gradation | |
|---|---|---|---|---|
| Procedure | Initial | 2 month | Initial | 5 month |
| 5A (comparison) | 100 | 79 | 0.82 | 0.63 |
| 5B (invention) | 100 | 98 | 0.82 | 0.81 |

| | Deficient fixation | | Precipitate in fixer | Sulfite loss (2 month) | |
|---|---|---|---|---|---|
| Procedure | Initial | 2 month | (5 month) | Developer | Fixer |
| 5A | no | occurred | occurred | 51% | 59% |
| 5B | no | no | no | 6% | 6% |

As seen from the results shown in Table 3, Procedure 5B according to the present invention induced no change of sensitivity and gradation and no fixation deficiency. Silver sludging occurred in the developing and fixing tanks of Procedure 5A whereas little sludging occurred in Procedure 5B.

Example 6

Procedure 5B of Example 5 was repeated except that the developing and fixing tanks were replaced by those shown in FIG. 4. Channels were provided such that overflows from the developing and fixing tanks entered the adjoining solution tanks, respectively. The electric conduction was the same as in Example 5. This is designated Procedure 6B.

Procedure 6B gave equivalent results to those of Procedure 5B of Example 5 and accomplished a lowering of waste liquid load as compared with an arrangement wherein overflows from the developing and fixing tanks were directly discharged.

In fact, Procedure 5A of Example 5 produced developer waste liquid having a COD value of 17,000 ppm and fixer waste liquid having a COD value of 5,000 ppm whereas the COD in Procedure 5B was 9,000 ppm for the developer and 3,000 ppm for the fixer.

Procedure 6B was repeated except that the developing and fixing tanks were replaced by those shown in FIG. 6 and the flow directions of overflows were changed accordingly, with equivalent results to Procedure 6B.

Example 7

Sheets of picture-taking black-and-white photosensitive material identified as sample 7 in Example 1 of U.S. Pat. No. 5,019,499 were exposed to light and subjected to running operation for two months according to the procedure of Table 4, with the quantity of photosensitive material processed set at 1 m$^2$ per day, using a modified model of processor FNCP 40B manufactured by Fuji Photo-Film Co., Ltd.

TABLE 4

| Procedure | Time | Temp. | Replenishment* | Tank volume |
|---|---|---|---|---|
| Development | 1 min. | 30° C. | 50 ml | 20 liters |
| Fixation | 2 min. | 30° C. | 50 ml | 40 liters |
| Rinse (1) | 1 min. | 30° C. | — | 20 liters |
| Rinse (2) | 1 min. | 30° C. | — | 20 liters |
| Rinse (3) | 1 min. | 30° C. | 350 ml | 20 liters |
| Drying | 2 min. | 58° C. | — | — |

*per 135-size, 24-frame film
Rinsing: three tank counterflow mode

The developer and fixer used in the procedure of Table 4 had the compositions shown in Tables 5 and 6.

TABLE 5

| Developer | Tank | Replenisher |
|---|---|---|
| $Fe(SO_4)$ | 15 g | 15 g |
| Diethylenetriamine-pentaacetic acid | 90 g | 90 g |
| KBr | 3.6 g | 2.5 g |
| Ascorbic acid | 10 g | 25 g |
| Water totaling to | 1.01 | 1.01 |
| pH (adjusted with NaOH) | 6.0 | 6.0 |

TABLE 6

| Fixer | Tank | Replenisher |
|---|---|---|
| Ammonium thiosulfate (70%) | 120 ml | 180 ml |
| $NaHSO_3$ | 10 g | 20 g |
| EDTA · 2Na | 2 g | 2 g |
| Water totaling to | 1.01 | 1.01 |
| pH (adjusted) | 7.0 | 6.0 |

The rinsing liquid used was deionized water. This procedure is designated Procedure 7A.

Procedure 7A was repeated except that the developing tank of the processor was charged with the developer which adjoined an electrolyte solution through an anion exchange membrane and equipped with electrodes as shown in FIG. 4. This procedure is designated Procedure 7B.

The electrolyte solution in the solution tank was a 3% solution of KCl. The cathode installed in the developing tank was a molybdenum-containing stainless steel (corresponding to SUS 316) sheet (NTK 316 manufactured by Nihon Metal Industry K.K., size 15 cm×100 cm×1 mm thick) and the anode installed in the electrolyte solution tank was a carbon sheet (Kure Sheet manufactured by Kureha Chemical Industry K.K., size 15 cm×100 cm'1 mm thick). The anion exchange membrane used was Neosepta AFN-7 (manufactured by Tokuyama Soda K.K.).

Electric conduction was by applying a voltage of 0.8 V to pass a current flow of 1.1 A (current density 0.5 mA/cm$^2$). The voltage was applied after 1 minute upon receipt of a signal indicative of the processing of photosensitive material and electric conduction was interrupted when no signal indicative of photosensitive material processing was received for 20 minutes.

For both Procedures 7A and 7B, sensitivity and gradation were examined at the start and the end of 2-month running operation. The sensitivity was expressed in relative sensitivity based on 100 at the start of running operation of Procedure 7A and the gradation was a gradient of a linear section of a photographic characteristic curve. The results are shown in Table 7.

TABLE 7

| | Sensitivity | | Gradation | |
|---|---|---|---|---|
| Procedure | Initial | 2 month | Initial | 2 month |
| 7A (comparison) | 100 | 30 | 0.61 | 0.27 |
| 7B (invention) | 100 | 100 | 0.61 | 0.60 |

Example 8

Procedure 7A of Example 7 was repeated except that the developing and fixing tanks were replaced by those shown in FIG. 3 wherein the developer and fixer adjoined an electrolyte solution through an anion exchange membrane. This procedure is designated Procedure 7C. In this Procedure, the cathodes in the developing and fixing tanks, anode in the electrolyte solution tank, electrolyte solution, anion exchange membrane, and electric conduction conditions were the same as in Example 7.

For both Procedures 7A and 7C, sensitivity, gradation, and fixation deficiency were examined at the start and the end of 2-month running operation. The sensitivity and gradation were examined as in Example 7. The fixation degree was examined by determining a silver amount in processed photosensitive material (processed by replenishing the fixer at a rate of 20 ml per 135-size, 24-frame film) by fluorescent X-ray spectroscopy, with a silver amount in excess of 5 $\mu g/cm^2$ judged to be deficient fixation. The results are shown in Table 8 wherein under the heading of deficient fixation, X represents its occurrence and O represents that fixation deficiency did not occur.

TABLE 8

| | Sensitivity | | Gradation | | Deficient fixation | |
|---|---|---|---|---|---|---|
| Procedure | Initial | 2 month | Initial | 2 month | Initial | 2 month |
| 7A (comparison) | 100 | 29 | 0.61 | 0.25 | O | X |
| 7C (invention) | 100 | 100 | 0.61 | 0.61 | O | O |

Example 9

Procedure 7A of Example 7 was repeated except that the processing system was replaced by that shown in FIG. 9. That is, Procedure 7C of Example 8 was modified such that an overflow from the first rinsing tank entered the electrolyte solution tank. The electrolyte solution tank was initially charged with an electrolyte solution which was obtained by diluting the tank fixer solution with water to a concentration of 3% of the tank fixer solution. This procedure is designated Procedure 7D. Procedure 7D gave equivalent satisfactory results to Procedure 7C and reduced the water usage (waste liquid volume) to about 50% as compared with Procedure 7C.

The procedures of Examples 7, 8 and 9 were repeated except that the metal compound developing agent was replaced by titanium trichloride and a developer containing 20 gram/liter of titanium trichloride (adjusted to pH 4.2) was used, obtaining similar results.

Example 10

Sheets of black-and-white X-ray film identified as sample 1 (Emulsion A) in Example 1 of U.S. Pat. No. 4,968,595 were exposed to light and subjected to running operation for one week according to the procedure of Table 9, with the quantity of photosensitive material processed set at 5 $m^2$ per day, using a modified model of medical film processor FPM-500 manufactured by Fuji Photo-Film Co., Ltd.

TABLE 9

| Procedure | Time | Temp. | Replenishment (per $m^2$) | Tank volume |
|---|---|---|---|---|
| Development | 25 sec. | 35° C. | 50 ml | 10 liters |
| Fixation | 25 sec. | 35° C. | 20 ml | 10 liters |
| Rinse (1) | 12 sec. | 35° C. | — | 5 liters |
| Rinse (2) | 12 sec. | 35° C. | 200 ml | 5 liters |
| Drying | 25 sec. | 55° C. | — | — |

Rinsing: two tank counterflow mode

The developer used in the procedure of Table 1 had the composition shown in Table 10, and the fixer used had the composition shown in Table 6 like Example 7. The developer was prepared to the composition of Table 10 and on use, subjected to electrolytic reduction to $V^{2+}$.

TABLE 10

| Developer | Tank | Replenisher |
|---|---|---|
| $V_2O_5$ | 40 g | 40 g |
| Oxalic acid | 28 g | 48 g |
| $H_2SO_4$ (47.5%) | 136 ml | 136 ml |
| Water totaling to | 1.01 | 1.01 |
| pH | 0.5 | 0.5 |

The rinsing liquid used was city water. This procedure is designated Procedure 10A.

Procedure 10A was repeated except that the processing system was replaced by that shown in FIG. 4 wherein electrolyte solution tanks having anion exchange membranes and electrodes were added. This procedure is designated Procedure 10B. That is, Procedure 7C of Example 8, except the processing solution compositions, was changed such that an overflow from the first rinsing tank flowed to the fixing tank and an overflow from the second rinsing tank flowed to the electrolyte solution tank. The electrolyte solution tank was initially charged with an electrolyte solution which was obtained by diluting the fixer (tank solution) with water to a concentration of 1% of the fixer. The developer shown in Table 10 was used in $V^{2+}$ form by previously conducting electricity. The electric conduction conditions included 3 V and 1.5 A, with a cathodic current density of 3 $A/dm^2$. Electric conduction was continued under the same conditions when the replenishers were supplied. Control was made so as to provide a redox potential of up to −0.18 V in a $N_2$ atmosphere at 25° C. It is to be noted that the electrolytic reduction conditions in Procedure 10A were substantially the same.

For both Procedures 10A and 10B, sensitivity, gradation, and fixation deficiency were examined at the start and the end of 1-week running operation as in Examples 7 and 8.

The results are shown in Table 11.

TABLE 11

| Procedure | Sensitivity | | Gradation | | Deficient fixation | |
|---|---|---|---|---|---|---|
| | Initial | 2 month | Initial | 2 month | Initial | 2 month |
| 10A (comparison) | 100 | 11 | 0.72 | 0.15 | O | X |
| 10B (invention) | 100 | 101 | 0.72 | 0.71 | O | O |

Procedure 10B diminished the fixer replenishment by about 60% as compared with Procedure 10A.

BENEFITS OF THE INVENTION

The present invention makes it easy to maintain and control the processing ability of processing solutions. Photographic images of quality are obtained over an extended period of continuous processing while the amount of processing solution replenished can be diminished.

We claim:

1. A photographic processing method wherein a silver halide photosensitive material is developed after exposure with a developer solution and processed with other solutions which include at least one of a first processing solution having a bleaching function and a second processing solution having a fixing function, said method comprising the steps of:

disposing one of said developer solution, said first processing solution and said second processing solution on one side of an anion exchange membrane and disposing one of said first processing solution and an electrolyte solution, which is different from said developer solution, said first processing solution and said second processing solution, on the other side of said membrane, wherein a solution on said one side of said membrane is different from a solution on said other side thereof; and conducting electricity across said membrane.

2. The photographic processing method of claim 1, wherein one of said developer solution and said second processing solution is disposed on said one side of said membrane and said first processing solution is disposed on said other side of said membrane, further comprising the steps of:

placing a cathode in said one of said developer solution and said second processing solution and an anode in said first processing solution; and conducting electricity between said cathode and said anode.

3. The photographic processing method of claim 1, wherein one of said developer solution, said first processing solution and said second processing solution are disposed on said one side of said membrane and said electrolyte solution is disposed on said other side of said membrane, further comprising the steps of;

placing one of a cathode and an anode in said electrolyte;

placing the other of said cathode and said anode in said one of said developer solution, said first processing solution and said second processing solution;

conducting electricity between said cathode and said anode.

4. A photographic processing method of claim 1, wherein said first processing solution is disposed on said one side of said membrane and said electrolyte solution is disposed on said other side of said membrane, further comprising the steps of:

placing an anode in said first processing solution and a cathode in said electrolyte solution; and conducting electricity between said cathode and said anode.

5. The photographic processing method of claim 1, wherein one of said developer solution and said second processing solution are disposed on said one side of said membrane and one of said first processing solution and said electrolyte solution are disposed on said other side of said membrane, further comprising the steps of:

placing a cathode in said one of said developer solution and said second processing solution and an anode in said one of said first processing solution and said electrolyte solution; and conducting electricity between said cathode and said anode.

6. A photographic processing method of claim 1, wherein said first processing solution is charged in a bleaching function tank, said disposing step further comprising the steps of:

juxtaposing a developing tank, which is charged with said developer solution, and said bleaching function tank such said membrane intervenes between said developer solution and said first processing solution;

placing a cathode in said developing tank and an anode in said bleaching function tank; and conducting electricity between said cathode and said anode.

7. A photographic processing method of claim 1, wherein said first processing solution is charged in a bleaching function tank, said disposing step further comprising the steps of:

disposing a tank charged with said electrolyte solution proximate a developing tank, which is charged with said developing solution, and said bleaching function tank such that a first portion of said membrane intervenes between said developer solution and said electrolyte solution and a second portion of said membrane intervenes between said first processing solution and said electrolyte solution;

placing a cathode in said developing tank and an anode in said bleaching function tank;

conducting electricity between said cathode and said anode.

8. The photographic processing method of claims 6 and 7 further comprising the steps of:

arranging a processing tank downstream of said bleaching function tank;

providing a second membrane in said processing tank, said second membrane at least partially comprising an anion exchange membrane;

charging said processing tank on one side or said second membrane with said second processing solution and placing a second cathode therein;

charging said processing tank on another side of said second membrane with an electrolyte solution and placing a second anode therein; and conducting electricity between said second cathode and said second anode.

9. The photographic processing method of claim 1, wherein said first processing solution is charged in a bleaching function tank, and said second processing solution is charged in a fixing function tank, said disposing step further comprising the steps of:

juxtaposing said bleaching function tank and said fixing function tank such that said membrane intervenes between said first processing solution and said second processing solution;

placing an anode in said bleaching function tank and a cathode in said fixing function tank; and conducting electricity between said cathode and said anode.

10. The photographic processing method of claim 1, wherein said first processing solution is charged in a bleaching function tank, and said second processing solution is charged in a fixing function tank, said disposing step further comprising the steps of:

interposing a tank charged with said electrolyte solution between said bleaching function tank and said fixing function tank such that a said membrane intervenes between said first processing solution and said electrolyte solution and a second membrane intervenes between said second processing solution and said electrolyte solution, said second membrane at least partially comprising an anion exchange membrane;

placing an anode in said bleaching function tank and a cathode in said fixing function tank; and conducting electricity between said cathode and said anode.

11. The photographic processing method of claim 10, further comprising the steps of:

providing a third membrane in a developing tank, said third membrane at least partially comprising an anion exchange membrane;

charging said developing tank on one side of said third membrane with said developer solution and placing a second cathode therein;

charging said developing tank on another side of said third membrane with an electrolyte solution and placing a second anode therein; and conducting electricity between said second cathode and said second anode.

12. A photographic processing method of claim 1, wherein said first processing solution is charged in a bleaching function tank, and said second processing solution is charged in a fixing function tank, said disposing step further comprising the steps of:

juxtaposing a developing tank, which is charged with said developer solution, and said bleaching function tank and juxtaposing said bleaching function tank and said fixing function tank such that said membrane intervenes between said developer solution and said first processing solution and a second membrane intervenes between said first processing solution and said second processing solution, said second membrane at least partially comprising an anion exchange membrane;

placing a cathode in said developing tank, an anode in said bleaching function tank, and a second cathode in said fixing function tank;

conducting electricity between said first and second cathodes and said anode.

13. The photographic processing method of claim 1, wherein said a first processing solution is charged in a bleaching function tank, and said second processing solution is charged in a fixing function tank, said disposing step comprising the steps of:

placing a tank charged with said electrolyte solution in juxtaposition to a developing tank, which is charged with said developer solution, such that said membrane intervenes between said developer solution and said electrolyte solution;

placing a cathode in said developing tank and an anode in said tank containing said electrolyte solution; and conducting electricity between said cathode and said anode.

14. The photographic processing method of claim 1, wherein said a first processing solution is charged in a bleaching function tank, and said second processing solution charged in a fixing function tank, said disposing step comprising the steps of:

placing a tank charged with said electrolyte solution in juxtaposition to said bleaching function tank such that said membrane intervenes between said first processing solution and said electrolyte solution;

placing an anode in said bleaching function tank and a cathode in said tank containing said electrolyte solution; and conducting electricity between said cathode and said anode.

15. The photographic processing method of claim 1, wherein said first processing solution is charged in a bleaching function tank, and said second processing solution is charged in a fixing function tank, said disposing step further comprising the steps of:

placing a first tank charged with said electrolyte solution in juxtaposition to said fixing function tank such that said membrane intervenes between said second processing solution and said electrolyte solution;

placing a cathode in said fixing function tank and an anode in said tank containing said electrolyte solution; and conducting electricity between said cathode and said anode.

16. The photographic processing method of claim 15, further comprising the steps of:

placing a second tank charged with said electrolyte solution in juxtaposition to a developing tank which is charged with said developing solution such that a second membrane intervenes between said developer solution and said electrolyte solution in said second tank, said second membrane at least partially comprising an anion exchange membrane;

placing a second cathode in said developing tank and a second anode in said second tank containing said electrolyte solution; and conducting electricity between said cathode and said anode.

17. The photographic processing method of claim 1, said disposing step further comprising the steps of:

placing a tank charged with an electrolyte solution in juxtaposition to a developing tank which is charged with said developer solution such that said membrane intervenes between said developer solution and said electrolyte solution;

placing a cathode in said developing tank and an anode in said electrolyte solution; and conducting electricity between said cathode and said anode.

18. A photographic processing method of claim 1, wherein said second processing solution is charged in a fixing function tank, said disposing step comprising the steps of:

placing a tank charged with an electrolyte solution in juxtaposition to said fixing function tank such that said membrane intervenes between said second processing solution and said electrolyte solution;

placing a cathode in said fixing function tank and an anode in said tank containing said electrolyte solution; and conducting electricity between said cathode and said anode.

19. The photographic processing method of claim 1, wherein said second processing solution is charged in a fixing function tank, said disposing step comprising the steps of:

placing a first solution tank in juxtaposition to a developing tank, which is charged with said developer solution, and placing a second solution tank in juxtaposition to said fixing function tank;

channelling said developer solution exiting from said developing tank and said second processing solution exiting from said fixing function tank to said first and second solution tanks, respectively;

placing said membrane between said developer solution and an electrolyte solution in said first solution tank and a second membrane between said first processing solution and an electrolyte solution in said second solution tank, said second membrane at least partially comprising an anion exchange membrane;

placing cathodes in said developing tank and said fixing function tank and anodes in said solution tanks; and conducting electricity between said cathodes and said anodes.

20. The photographic processing method of claim 1, wherein said second processing solution is charged in a fixing function tank, and rinsing solution is charged in at least first and second rinsing tanks, said disposing step comprising the steps of:

placing a tank charged with an electrolyte solution such that said developer solution and said first processing solution are in contact with said electrolyte solution through said membrane;

channeling at least part of the rinsing solution in the first rinsing tank disposed adjacent the fixing function tank to said fixing function tank, and channeling at least part of the rinsing solution in the second rinsing tank to said tank containing said electrolyte solution;

immersing cathodes in said developer solution and said second processing solution, and immersing an anode in said electrolyte solution; and conducting electricity between said cathodes and said anode.

21. The photographic processing method of any one of claims 2–6, 9, or 11–20, wherein said conducting step takes place during processing of said photosensitive material.

22. The method of claim 7, wherein said conducting step takes place during processing of said photosensitive material.

23. A photographic processing method using a processing tank which is partitioned into first and second compartments by an anion exchange membrane, said method comprising the steps of:

placing a cathode in the first compartment;

placing an anode in the second compartment;

filling the first compartment with one of a color developer, a black and white developer and a fixing solution;

filling the second compartment with one of a bleaching solution and an electrolyte solution; and conducting electricity between the first and second compartments.

24. A photographic processing method using a processing tank which is partitioned into first, second, and third compartments by anion exchange membranes, said method comprising the steps of:

placing a cathode in the first compartment;

placing an anode in the third compartment;

filling the first compartment with one of a color developer, black-and-white developer, and a fixing solution;

filling the second compartment with an electrolytic solution;

filling the third compartment with a bleaching solution; and conducting electricity between the first and third compartments.

* * * * *